US006929704B2

(12) United States Patent
Komatsubara et al.

(10) Patent No.: US 6,929,704 B2
(45) Date of Patent: Aug. 16, 2005

(54) GRAIN-ORIENTED ELECTROMAGNETIC STEEL SHEET

(75) Inventors: Michiro Komatsubara, Okayama (JP); Toshito Takamiya, Okayama (JP); Kunihiro Senda, Okayama (JP)

(73) Assignee: JFE Steel Corporation (JP)

( * ) Notice: Subject to any disclaimer, the term of this patent is extended or adjusted under 35 U.S.C. 154(b) by 53 days.

(21) Appl. No.: 10/163,522

(22) Filed: Jun. 6, 2002

(65) Prior Publication Data

US 2003/0121566 A1 Jul. 3, 2003

Related U.S. Application Data

(62) Division of application No. 09/557,230, filed on Apr. 24, 2000, now Pat. No. 6,444,050, which is a division of application No. 08/953,920, filed on Oct. 20, 1997, now Pat. No. 6,083,326.

(30) Foreign Application Priority Data

Oct. 21, 1996 (JP) ..... 8-278135
Aug. 18, 1997 (JP) ..... 9-235497
Aug. 18, 1997 (JP) ..... 9-235498

(51) Int. Cl.[7] ..... H01F 1/147; H01F 1/18
(52) U.S. Cl. ..... 148/113; 148/111
(58) Field of Search ..... 148/110–113

(56) References Cited

U.S. PATENT DOCUMENTS

| | | | | |
|---|---|---|---|---|
| 3,636,579 A | | 1/1972 | Sakakura et al. | |
| 4,203,784 A | * | 5/1980 | Kuroki et al. | 148/111 |
| 4,767,469 A | * | 8/1988 | Salsgiver et al. | 148/111 |
| 4,863,531 A | * | 9/1989 | Wada et al. | 148/111 |
| 4,960,652 A | * | 10/1990 | Wada et al. | 428/611 |
| 5,223,048 A | | 6/1993 | Inokuti | |
| 5,296,051 A | * | 3/1994 | Inokuti et al. | 148/113 |
| 5,718,775 A | | 2/1998 | Komatsubara et al. | |

FOREIGN PATENT DOCUMENTS

| | | | | |
|---|---|---|---|---|
| DE | 35 36 737 | | 4/1986 | |
| EP | 0 184 891 | | 6/1986 | |
| EP | 0 438 592 | | 7/1991 | |
| EP | 0 539 236 | | 4/1993 | |
| EP | 0 662 520 | | 7/1995 | |
| EP | 0 716 151 | | 6/1996 | |
| JP | 56 130454 | | 10/1981 | |
| JP | 06 245769 | | 12/1985 | |
| JP | 4-32517 | * | 4/1992 | 148/113 |
| JP | 06 089805 | | 3/1994 | |

OTHER PUBLICATIONS

Journal of Applied Physics, "Development of Domain Refined Grain–Oriented Silicon Steel By Grooving", vol. 73, No. 10 P.T. 02B, May 15, 1993, pp. 6609–6611.

* cited by examiner

*Primary Examiner*—John P Sheehan
(74) *Attorney, Agent, or Firm*—DLA Piper Rudnick Gray Cary US LLP

(57) ABSTRACT

A grain-oriented electromagnetic steel sheet having a multiplicity of fine grains having a diameter of about 3 mm or less on the surface of the steel sheet, in a numerical ratio of about 65% or more and of about 98% or less relative to the constituting grains that penetrate the sheet along the direction parallel to its thickness, and a method for producing the same. The fine grains are artificially created and regularly disposed with a random orientation in the steel sheet, and contribute to decreasing the strain susceptibility of the steel. More preferably, a treatment for finely dividing magnetic domains is applied on the surface of the steel sheet.

Transformers based upon the steel sheet have excellent magnetic characteristics (iron loss and magnetic flux density) together with strain resistance, and the steel sheet has good practical device characteristics (building factor) after being assembled into a transformer.

21 Claims, 11 Drawing Sheets

GRAIN-ORIENTED ELECTROMAGNETIC STEEL SHEET

This application is a divisional of application Ser. No. 09/557,230, filed on Apr. 24, 2000, now U.S. Pat. No. 6,444,050, which in turn is a divisional of application Ser. No. 08/953,920, filed Oct. 20, 1997, now U.S. Pat. No. 6,083,326, incorporated herein by reference.

BACKGROUND OF THE INVENTION

1. Field of the Invention

This invention relates to a grain-oriented electromagnetic steel sheet used as a core material of transformers and power generators, especially to a grain-oriented electromagnetic steel sheet having low iron loss and excellent strain resistance and excellent performance in use.

2. Description of the Related Art

Grain-oriented electromagnetic steel sheets containing Si having crystal grains oriented along the (110) {001} or (100) {001} direction are widely used for various kinds of iron cores operated at commercial frequencies because of good soft-magnetic properties. An important property required of this kind of electromagnetic steel sheet is low iron loss (generally represented by electric loss $W_{17/50}$ (W/kg) when the steel sheet is magnetized to 1.7T at a frequency of 50 Hz).

Methods for reducing the iron loss of a steel sheet include increasing electric resistance by adding Si which is effective for reducing eddy current loss of a steel sheet, or reducing the thickness of the steel sheet, or making the grain diameter small, or aligning the orientation of grains that are effective for reducing hysteresis loss.

Among those methods, addition of Si encounters limitations since decrease of saturation magnetic flux density may be induced when the amount of Si is excessive, and expansion of iron core size is caused. Reducing the thickness of the steel sheet, on the other hand, tends to result in excessive production cost increase.

Accordingly, recent technical developments for reducing iron loss have concentrated on improving alignment of crystal orientations and reducing the grain size in the steel. The alignment of orientations can usually be evaluated by magnetic flux density $B_8$ (T) at a magnetization strength of 800 A/m. However, the alignment of orientations should be optimized, i.e., the $B_8$ value should be adjusted to its optimum in order to obtain minimum iron loss, because an inconsistent relationship exists wherein improving the alignment of crystal orientations inevitably results in an increase of grain diameter and hence deterioration of iron loss.

The requirement to make the grain diameter small for reducing the iron loss has been eliminated thanks to the recent technical development by which the width of magnetic domains can be finely divided artificially by irradiating with a plasma jet or laser beam. Therefore, the method for reducing the iron loss by increasing the alignment of orientations has became a leading technique today, allowing development of a material having a magnetic flux density ($B_8$) of as large as 1.93 to 2.00T.

Processing methods developed for finely dividing magnetic domains include not only forming linear grooves or introducing linear local stress, but also smoothing the roughness of the interface between the surface of the steel sheet and the non-metallic coating film, or applying crystal orientation emphasis on the surface of the metal. Finely dividing the magnetic domains enabled some improvement of iron loss characteristics.

It is necessary that secondary recrystallization is perfectly controlled to enhance the alignment of orientations. In secondary recrystallization growth of normal crystal grains can be suppressed by finely dispersing precipitates of inhibitors such as AlN, MnSe or MnS, thereby allowing growth of large grains along a specified preferable ((110)[001]) direction and nearby directions referred to as Goss directions. Inhibitor elements tending to segregate at grain boundaries, such as Sb, Sn and Bi, are also used as sub-inhibitors.

Production of electromagnetic steel sheets having a high magnetic flux density as described above has involved combining the foregoing techniques with a technique adapted to control the aggregated textures of crystal grains.

When a transformer was produced using a grain-oriented electromagnetic steel sheet having good soft-magnetic properties, however, the transformer often failed to have the characteristics required for practical use. This is especially true in the case of a laminated transformer where the steel sheet is used without applying stress-relief annealing after shear processing, which causes discrepancies between the characteristics of the materials and especially the performance a large transformer. Performance in final usage is referred to herein generically as "performance of a practical device."

There have been problems in the prior art that expected characteristics suitable for practical devices cannot always be obtained even when a transformer is produced by using a grain-oriented electromagnetic steel sheet having a high magnetic flux density. This is an intrinsic problem when a material having a high magnetic flux density is used. It was elucidated that an undesirable distorted flow of the magnetic flux that causes digression of the magnetic flux from its flow direction takes place at the T-shaped junction of the transformer, so that reduction of the iron loss cannot be attained. This problem was considered to be beyond improvement.

However, the practical performance of a transformer or other device is largely deteriorated even when recent materials are used in which the flux density has been much more improved.

The phenomenon, wherein iron loss characteristics deteriorate under shear processing and lamination, was observed as being accompanied by improvement of magnetic flux density. This phenomenon is still under investigation. The only countermeasures now available at hand are to suppress addition of strain as much as possible, by careful handling of the material.

Although it is doubtless true that iron loss characteristics have been improved by various techniques for finely dividing magnetic domains as described above, yet there remain problems, since the desired characteristics cannot be attained when a practical device is produced using the materials now available, especially when the device is used in a high magnetic field.

The method step of imparting high magnetic flux density to the grain-oriented steel sheet has been known in the art and elements such as Al, Sb, Sn and Bi are effective for the purpose.

A value of 1.981T is reported in Japanese Examined Patent Publication No. 46-23820 as $B_{10}$ (the magnetic flux density under a magnetic field strength of 1000 A/m) in a grain-oriented electromagnetic steel sheet containing Al and S, while a value of 1.95T is reported in Japanese Examined Patent Publication No. 62-56923 as $B_8$ in a grain-oriented electromagnetic steel sheet containing Al, Se, Sb and Bi as inhibitors.

The magnetic properties of these grain-oriented electromagnetic steel sheets are splendid, but when a transformer is produced using these electromagnetic steel sheets having a desired value for iron loss of the resulting device cannot be often obtained. This is believed to originate, as hitherto described, from a high alignment of crystals that cannot be avoided.

SUMMARY OF THE INVENTION

Accordingly, an object of the present invention is to provide a grain-oriented electromagnetic steel sheet without causing deterioration of performance while improving the magnetic characteristics of the material. We have accordingly studied the reasons, in a material having secondary recrystallized grains that are highly aligned, why the performance is largely deteriorated below the level presumed because of iron loss of the material, and why the material is so sensitive to strain applied during further processing steps. As a result, we have discovered the following procedures.

We have investigated a variety of causes affecting distorted flow of the magnetic flux at the T-shaped junction parts of laminated transformers in which a material of high magnetic flux density is used.

It was found for the first time that the cause of deterioration is not only a highly aligned orientation but also by the grain diameter.

Meanwhile, the following facts were also found with respect to the effect of strain introduced during further processing of the sheet.

Iron loss is reduced due to refinement of magnetic domains. Generally, magnetic domains are divided by the mechanism that finely divided domains can reduce magnetostatic energy once increased by the appearance of magnetic poles at grain boundaries or on surfaces of steel sheets. Therefore, the generation of magnetic poles is the origin of reducing iron loss.

In materials having a high alignment of grain orientations, more magnetic poles appear at the grain boundaries than on the surface of the steel sheet. Moreover, the distances between the grain boundaries become large because of large grain diameters in these materials, which makes magnetostatic energy generate weakly. The introduced strains suppress the generation of magnetic poles more strongly inside the steel than on the surface. Thereby, in these materials, the increment of magnetostatic energy caused by magnetic poles at grain boundaries or by those in domain refinement area is reduced by disappearing magnetic poles through introducing strains, resulting in the enlargement of magnetic domain and in increase in iron loss.

While, in the cause of the materials having small grains and a low alignment of grain orientations, magnetic poles appear preferably on the surface of the steel, which makes iron loss of these material stable against introducing strains. We have discovered that this is the reason why an electromagnetic steel sheet with high magnetic flux density is so sensitive to strain.

DESCRIPTION OF PREFERRED EMBODIMENTS

Figure 1:
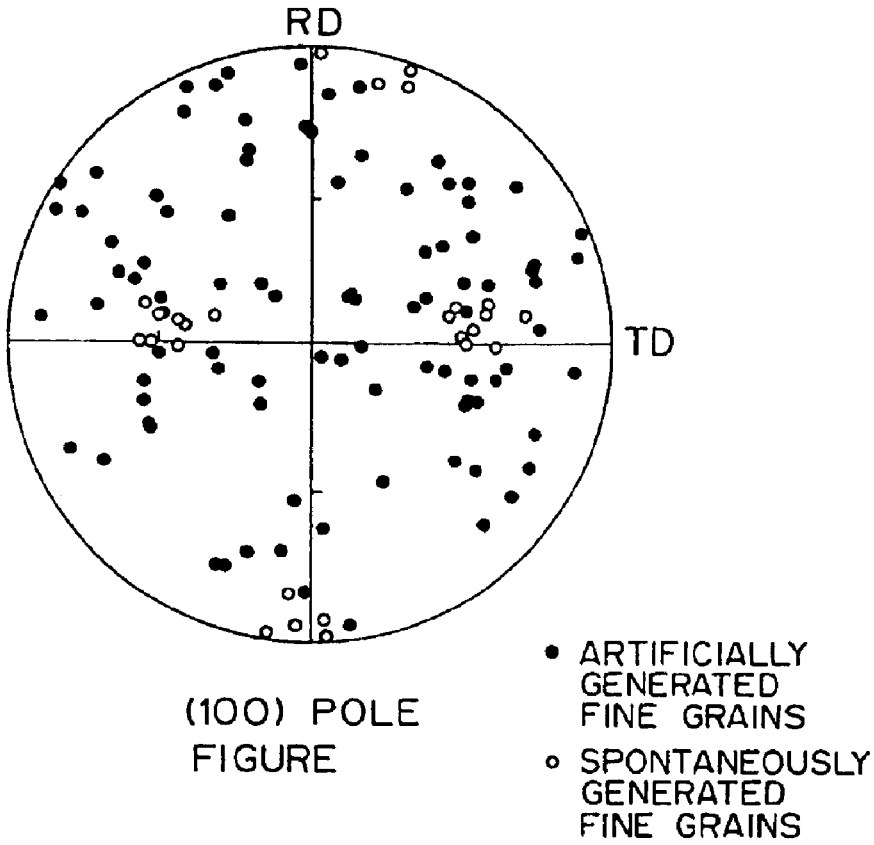
FIG. 1 is a (100) pole figure according to this invention showing the crystal orientation of artificially generated fine grains in comparison with the orientation of spontaneously generated fine grains in the same steel sheet.

The following experiment is offered as an example from which the foregoing concepts have been derived.

A hot-rolled sheet for grain-oriented electromagnetic steel comprising 0.08 wt % of C, 3.35 wt % of Si, 0.07 wt % of Mn, 0.025 wt % of Al, 0.020 wt % of Se, 0.040 wt % of Sb and 0.008 wt % of N with a balance of inevitable impurities and Fe was hot rolled and annealed at 1000° C. for 30 minutes followed by pickling. After applying cold rolling at a reduction of 30%, the sheet was subjected to heat treatment as an intermediate annealing at 1050° C. for 1 minute, followed by pickling again. Then a steel sheet having a thickness of 0.22 mm was produced by applying warm rolling with a reduction of 85% at a temperature of 150 to 200° C.

After degreasing treatment, linear grooves having a depth of 25 μm and a width of 50 μm were provided toward the direction tilted by 10° to the transverse direction with repeating pitches of 3 mm along the longitudinal direction of the sheet for the purpose of finely dividing the magnetic domains. Then, after applying the annealing for decarburization and for primary recrystallization at 850° C. for 2 minutes, the steel sheet was divided into two pieces. One of them was used as a conventional material while the other was subjected to momentary heat treatment by a dotted electric discharge with an area of 1.5 mm in diameter having pitches of 20 mm along the transverse direction and 30 mm along the longitudinal direction of the sheet on the surface of the steel sheet, to apply energy from 40 to 45 Ws (corresponding to an estimated heat treatment at 1000 to 1200° C.).

After coating the surface of the steel sheet with MgO as an annealing separator supplemented with 10 wt % of $TiO_2$ and 2 wt % of $Sr(OH)_2$, the sheet was wound up into a coil to subject it to final finish annealing. Final finish annealing was applied for the purpose of secondary recrystallization in $N_2$ up to a temperature of 850° C. and in a mixed atmosphere of $H_2$ and $N_2$ up to a temperature of 1150° C., followed by keeping at 1150° C. in $H_2$ for the purpose of purification.

After final finish annealing, the unreacted annealing separator was removed and a tension coating comprising 50% of colloidal silica and magnesium phosphate was applied to supply the sheet as a final product.

After measuring the magnetic properties of each product, a model transformed was produced via slit processing, shear processing and lamination processing. The steel sheets used in the transformer were subjected to macro-etching to determine the diameter of grains in the sheet.

Slit processing, shear processing and lamination processing described above were carefully applied in order to suppress strain as much as possible. To experimentally evaluate the effect of applied strains, a caster carrying a sphere 50 mm in diameter was pressed on the sheet with a load of 5 kg in a separate experiment to purposely apply strains.

The results obtained are summarized in Table 1.

factor was especially large when strains were applied using a caster during the production process, indicating that the degree of iron loss decrease of the transformer was quite large, i.e., the products (c) and (d) not subjected to such treatment had large susceptibility to strain.

The appearance of grains and distribution of the magnetic flux in the model transformer were precisely investigated. In the products (a) and (b) in which secondary grains have grown after applying dotted temporary high temperature heat treatment on a decarburization annealed sheet with an area of 1.5 mm in diameter, it was found that fine grains having a diameter of 0.5 to 2.5 mm were formed by penetrating the steel sheet along the direction parallel to its thickness at the site where such treatment was applied. In the products (c) and (d) in which no such treatment was applied, on the other hand, most of the grains were composed of coarse grains having a diameter of 20 to 70 mm within the steel sheet.

When the orientation of these artificially grown fine grains was measured, it had a random orientation deviating by 15° or more from the Goss orientation that is the ordinary orientation of secondary recrystallization grains.

For a comparative purpose, fine grains were artificially formed on a steel sheet with a periodic distance along the transverse direction of 10 mm and a periodic distance along the longitudinal direction of 15 mm by the same method as in the products (a) and (b). It was confirmed from an observation of the macro-structure of the steel sheet that fine grains had been definitely formed at the site where momentary high temperature treatment was applied, although spontaneously grown fine grains could be rarely observed. The orientation of the artificially generated fine grains is shown in the (100) pole figure in FIG. 1 of the drawings, in comparison with that of spontaneously occurring fine grains. In contrast to the fact that the orientation of the spontaneously generated fine grains have an orientation very close to the Goss orientation, it is clear that the orientation of the artificially generated fine grains was randomly distributed.

TABLE 1

| Dotted discharge heat treatment | Strain inducing treatment | Magnetic characteristics of product $B_8$ (T) | $W_{17/50}$ (W/kg) | Magnetic performance of transformer $W_{17/50}$ (W/kg) | Building factor | Macro-crystalline structure of product: Number ratio of grains with a diameter of 2.5 mm or less (%) | Mean grain diameter (mm) | Symbol |
|---|---|---|---|---|---|---|---|---|
| Yes | No | 1.967 | 0.683 | 0.778 | 1.14 | 89.2 | 10.6 | (a) |
| | Yes | 1.966 | 0.683 | 0.785 | 1.15 | | | (b) |
| No | No | 1.969 | 0.685 | 0.856 | 1.25 | 31.1 | 27.5 | (c) |
| | Yes | 1.968 | 0.684 | 0.973 | 1.42 | | | (d) |

As is evident from Table 1, the products (a) and (b) subjected to a secondary recrystallization after applying dotted high temperature heat treatment with an area of 1.5 mm in diameter after primary recrystallization combined with decarburization annealing were very excellent in iron loss of the model transformer. The ratio of iron loss in the product steel sheets to that of the transformer was low. In the products (c) and (d), on the contrary, the iron loss of the model transformer was largely decreased. The transformer The results of measurement of grain diameter distribution with respect to the grains penetrating through the direction parallel to the direction of the thickness of the two different products described above are listed in Table 2.

The diameter of each grain was calculated from the diameter of a circle corresponding to the area of the grain. The mean grain diameter was represented by the diameter of a circle corresponding to the mean area per single grain that was derived from the number of grains within a definite area.

TABLE 2

| | Grain diameter (mm) | | | | | | | | | | Mean |
|---|---|---|---|---|---|---|---|---|---|---|---|
| | ≦0.5 | 0.5~1.0 | 1.0~2.5 | 2.5~5.0 | 5.0~10 | 10~15 | 15~20 | 20~40 | 40~70 | ≧70 | grain diameter |
| Discharge treatment | 26.3 | 42.3 | 20.6 | 2.4 | 0.0 | 0.0 | 1.6 | 4.7 | 2.1 | 0.0 | 10.6 |
| No treatment | 10.9 | 11.5 | 8.7 | 4.9 | 2.4 | 4.3 | 12.7 | 30.1 | 14.5 | 0.0 | 27.5 |

It is evident from Table 2 that the number ratio of fine grains having a diameter of 2.5 mm or less was about 30% of which the proportion of grains with a grain size of 15 to 70 mm accounts for about 60% of the products (c) and (d) having a large building factor and deteriorated transformer performance. In the products (a) and (b) having a low building factor and excellent transformer performance, on the other hand, the number ratio of the fine grains having a diameter of 2.5 mm or less is about 90% together with a number ratio of the fine grains having a diameter of 15 to 70 mm of as low as 8%.

It was evident that the number ratio of the fine grains having a different range of grain diameters is greatly different between the two kind of materials having different building factors with each other. Therefore, the next investigation was focused on the mechanism why the presence of such fine grains resulted in a decrease in the building factor and susceptibility to strains, i.e. improvements in strain resistance.

Studies on the flux flow at the T-junction part in the model transformer revealed that distorted flow of the magnetic flux was suppressed by the presence of fine grains. In other words, the fine grains incorporated in coarse grains suppress distorted flow of the magnetic flux irrespective of increased alignment of the orientation of the coarse grains. Thus, the building factor could be suppressed to a low value although the magnetic flux density in the material was high.

Next, the effect on strain resistance was investigated.

When strain is applied to a steel sheet, magnetic energy caused by the strain increases while magnetostatic magnetic energy is relatively decreased. Thereby the effect of finely dividing the magnetic domains is offset.

It is effective to confront this effect that energies such as magnetoclastic energy or magnetostatic energy that contribute to finely dividing the magnetic domains are previously applied to the steel sheet in an amount larger than the energy increment added by strains.

Such additional energies include tension energy as well as magnetostatic energy.

A coating method that can apply a stronger tension energy than the conventional ones is not available. When the coating thickness is increased, the spacing factor of the steel sheet so decreases that the transformer performance deteriorates.

With regard to magnetostatic energy, magnetic poles will be generated in the grain boundary for the reason hitherto described when the magnetic flux density and alignment of the grain orientation are increased. Moreover, the amount of magnetostatic energy will be largely decreased due to increased distances among grain boundaries accompanied by coarsening of the grain diameter.

In the artificially formed fine grains, however, their orientation is largely deviated from Goss orientation (usually 15° or more). It is made possible to increase the magnetostatic energy by the presence of such fine grains in the coarse grains, which accompanies an improvement of the strain resistant property of the product.

For the purpose of allowing this effect to be fully displayed, it is crucial that the fine grains should have a grain diameter enough to penetrate the sheet along a direction parallel to its thickness.

If the fine grains do not penetrate the sheet, the grain boundary area component projected on the surface perpendicular to the rolling direction will be small, which causes to reduce the number of magnetic poles in the sheet and appearing on the grain boundary. Thereby the effect for enhancing magnetostatic energy would be weakened. Since the effect of suppressing distorted flow of the magnetic flux is also weakened, the building factor is accordingly increased.

The relation between the number ratio of the fine grains having a diameter of 3 mm or less to the total crystal grains penetrating the steel sheet along the direction parallel to its thickness, and the building factor including the strain resistant property was examined. The results are shown in FIG. 2.

Figure 2:
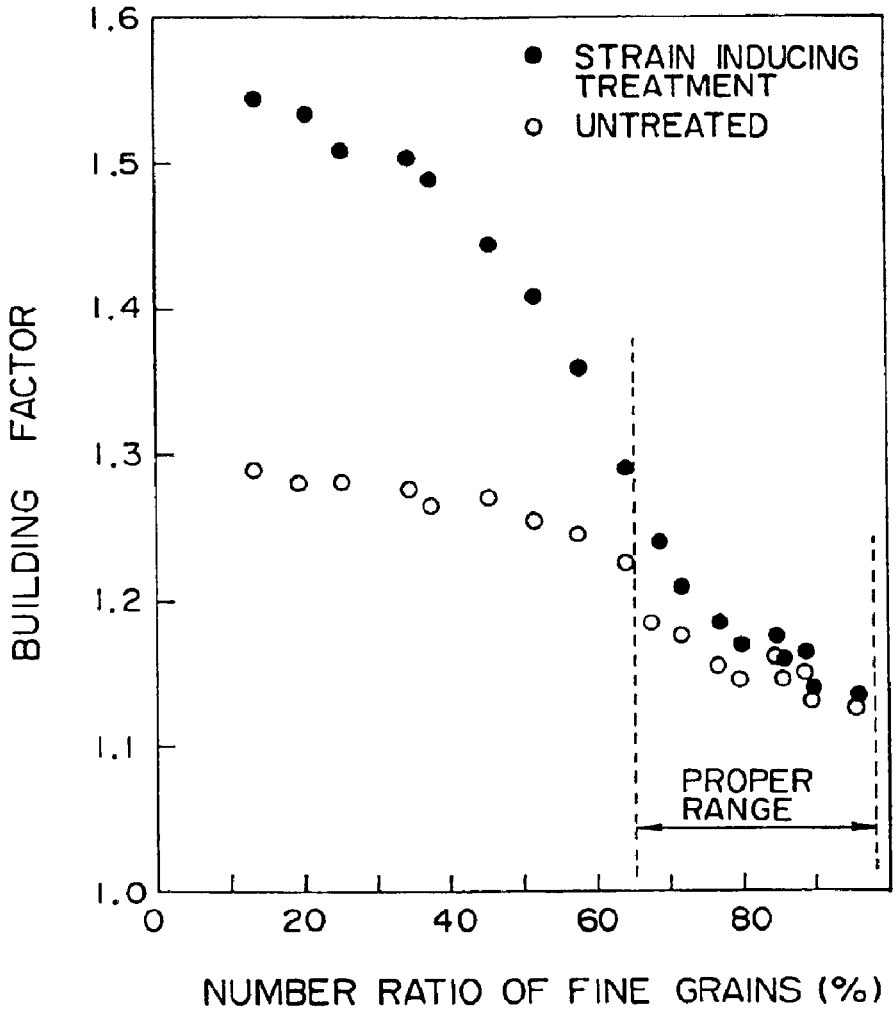
FIG. 2 is a graph showing how the iron loss ratio of the transformer against the iron loss characteristics (building factor) and strain resistant properties are affected by the number ratio of grains in the steel sheet having a diameter of 3 mm or less.

As is evident from FIG. 2, the building factor becomes low in the range where the number ratio of the fine particles is 65 to 98%, especially 75 to 98%, besides the strain resistant property (evaluated by the building factor at the time of processing to be endowed with a strain) is improved.

The proper mean grain diameter for all the grains penetrating the sheet was experimentally determined. While the coarse grains are still more coarsened as the magnetic flux density is improved, the number ratio of the fine grains increases in response to coarsening. However, since the distance among the fine grains is also substantially increased in response to the increase of the number of coarse grains even when the number ratio of the fine grains remains unchanged, an effect for enhancing the magnetostatic energy by the presence of the fine grains cannot be much expected. Therefore, there would be a preferable upper limit in the mean grain diameter.

Figure 3:
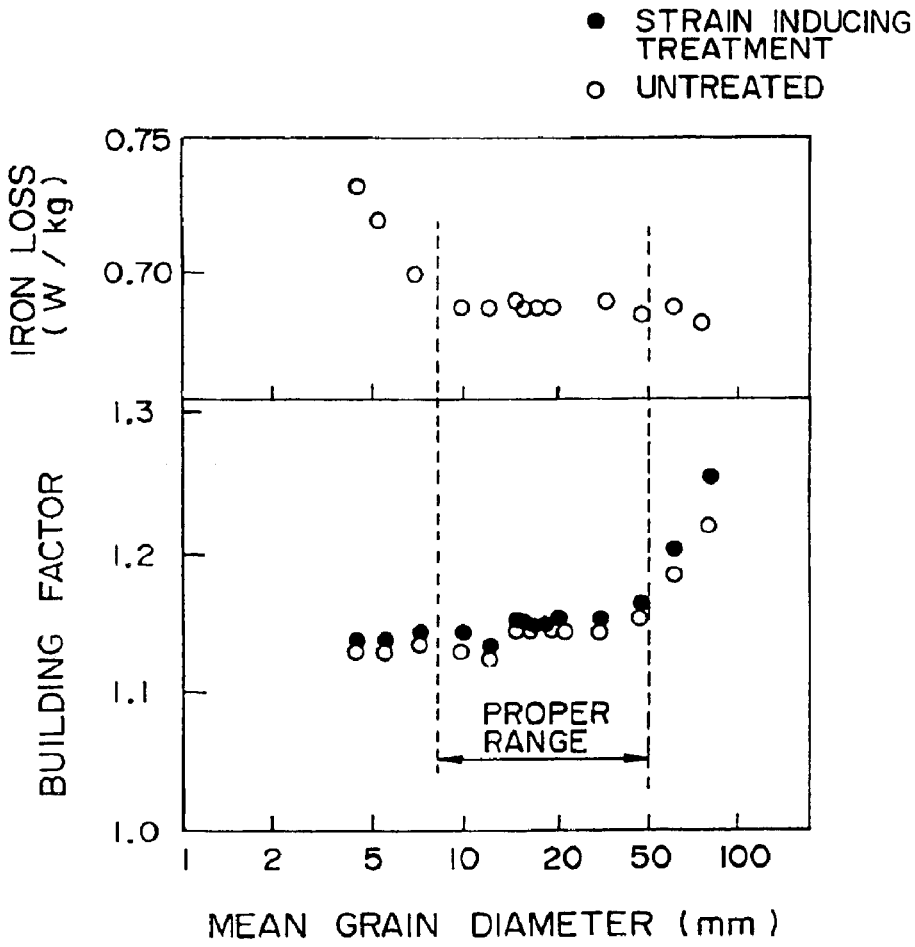
FIG. 3 is a graph showing the relation between the mean grain diameter of the grains penetrating the grain-oriented electromagnetic steel sheet and the iron loss characteristics, and the building factor or building factor of the transformer after strain inducing processing.
Figure 4:
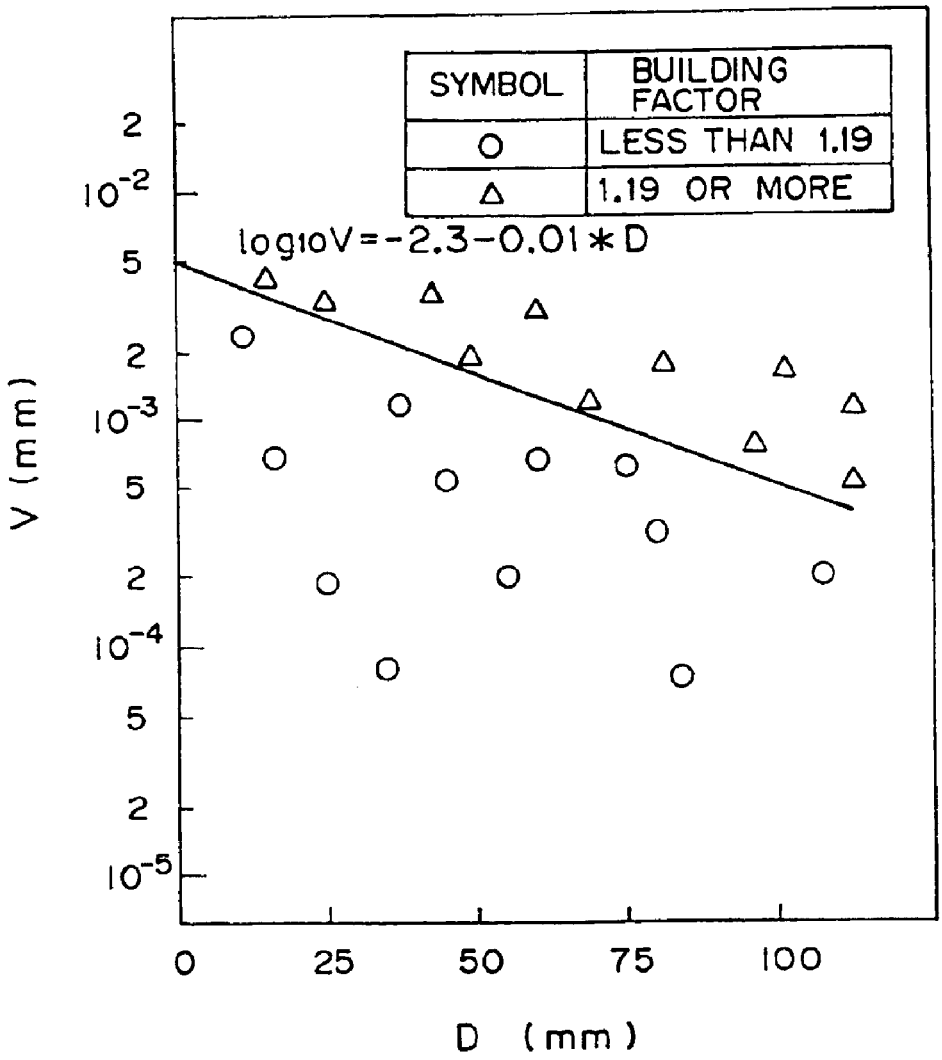
FIG. 4 is a graph of the total volume ratio V of the grooves per unit area of the steel sheet in relation to the mean diameter D of crystal grains having a diameter of more than 3 mm with respect to the grooves repeatedly provided along the rolling direction.
Figure 5:
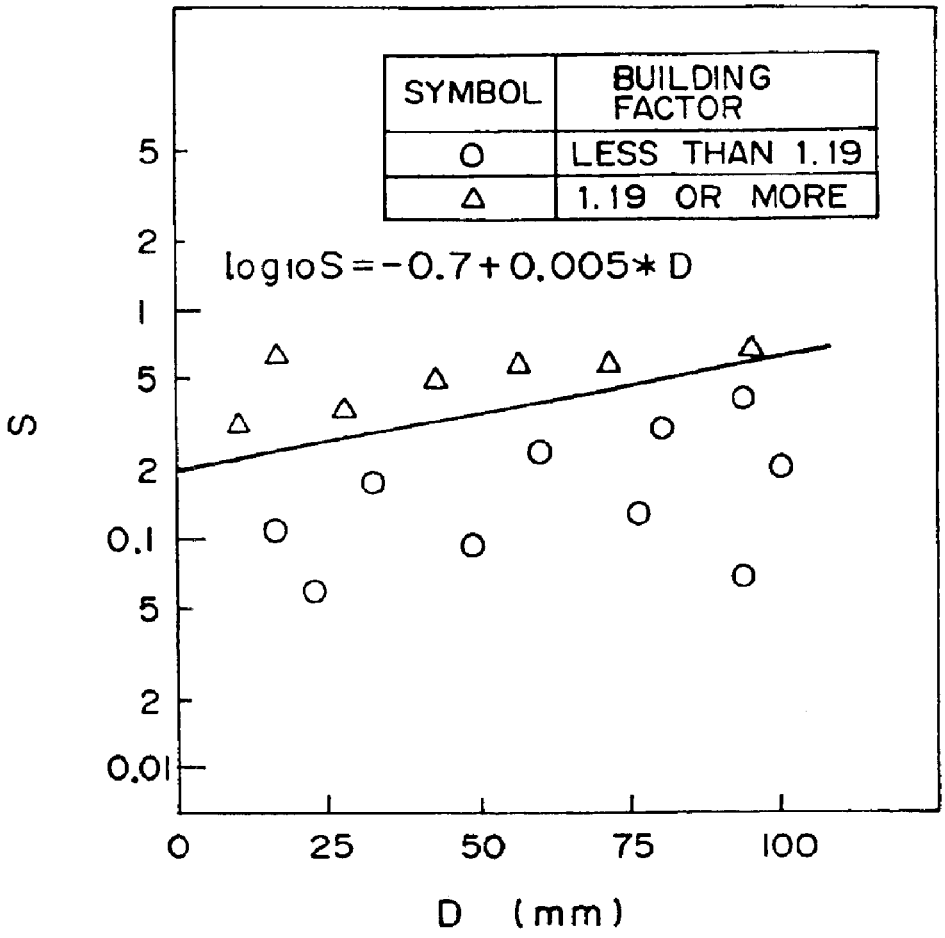
FIG. 5 is a graph of the total area S of local stress region per unit area of the steel sheet in relation to the mean diameter D of grains having a diameter of more than 3 mm with respect to a linear stress region repeatedly provided along the rolling direction.
Figure 6:
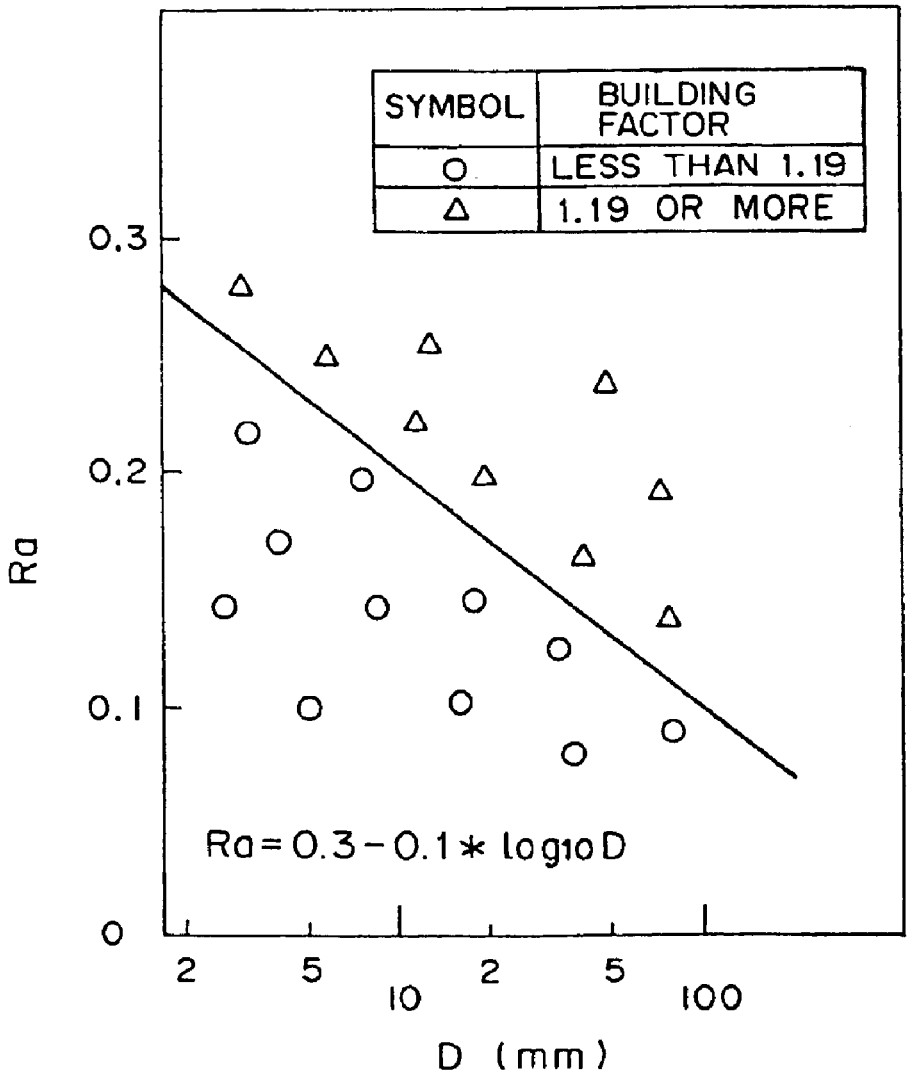
FIG. 6 is a graph of the average surface roughness Ra of a steel sheet in relation to the mean diameter D of the crystal grains having a diameter of more than 3 mm with respect to the roughness of the boundary face between the surface of the steel sheet and non-metallic coating film.
Figure 7:
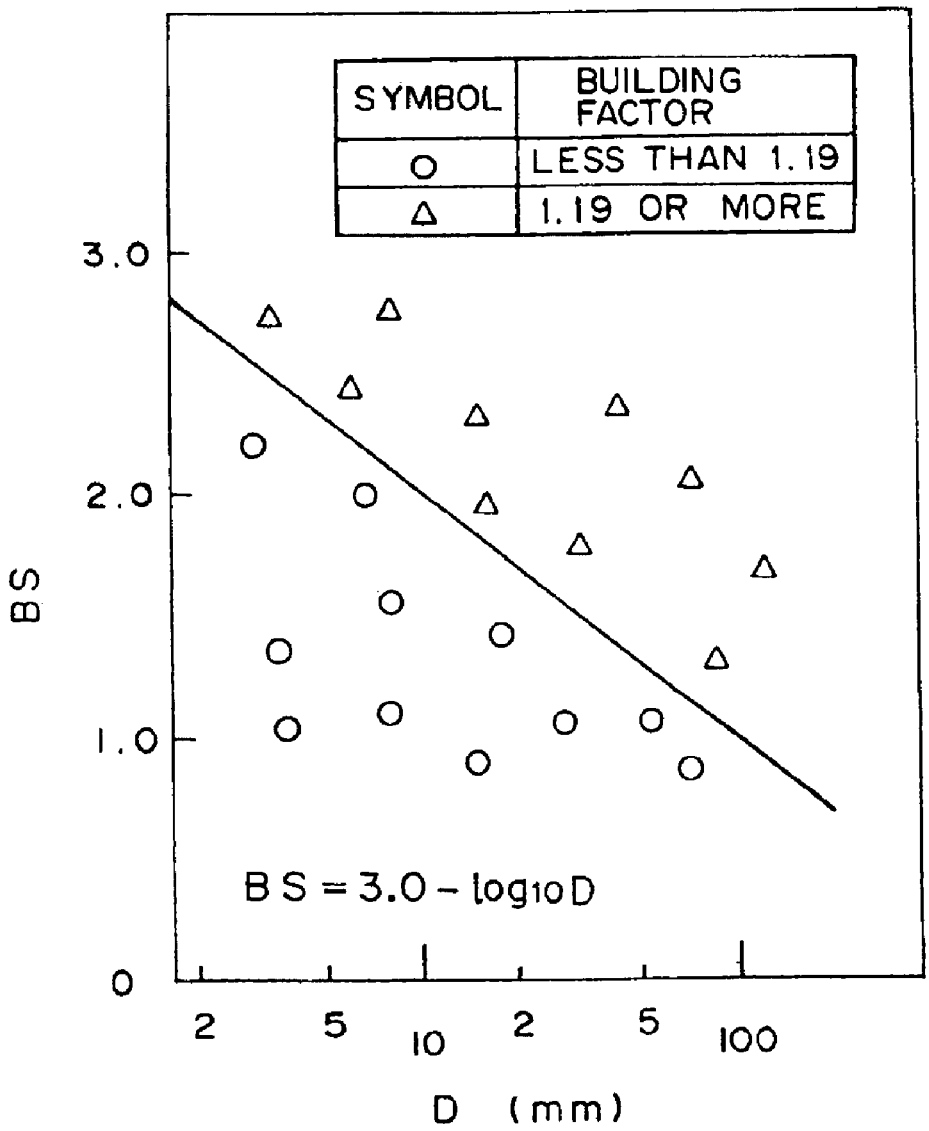
FIG. 7 is a graph of the mean grain boundary step BS for obtaining a best building factor in relation to the mean diameter D of the crystal grains having a diameter of more than 3 mm with respect to the crystal grain orientation emphasizing treatment applied on the surface of the steel sheet.

The experimental results on these problems above are shown in FIG. 3.

As is evident from the figure, especially good effects for improving the building factor and strain resistant property can be obtained in the range where the mean grain diameter of all the crystal grains penetrating the sheet is about 8 to 50 mm.

The mechanism as to why increase of the building factor is suppressed and why the strain resistant property is improved by the formation of fine grains penetrating the sheet along the direction parallel to its thickness was elucidated by the descriptions above.

Next, the results of studies on the essential factors for producing fine grains necessary to display such effects are described hereinafter.

From the results of various studies, it was made clear that it is necessary to enhance the driving force for locally promoting the growth of abnormal grains prior to secondary recrystallization for the purpose of forming fine grains creating the foregoing effect. Especially, it is effective to cause a prescribed amount of strain in the steel sheet to exist.

Secondary recrystallization is defined as a phenomenon in which primary grains having a specific orientation rapidly grow by invading into other primary grains. Recently, it has been made clear that selectivity due to the texture of the primary recrystallization grains has a strong influence on nucleus formation and growth of the secondary recrystallization grains. Therefore, it is supposed that formation of nucleus and growth of secondary grains having an orientation largely deviated from the Goss orientation is not easily achieved.

According to our studies however, it is possible to enhance the driving force for nucleus formation and abnormal growth of such grains by enhancing the driving force at a specific region in the steel sheet, for example introducing a prescribed amount of strain. Thereby the grains having an orientation largely deviated from the Goss orientation can be made to grow at the initial stage.

The term "abnormal grain growth" in this specification denotes in general the phenomenon wherein quite minor grains rapidly grow by invading into other overwhelmingly major crystal grains. Secondary recrystallization is distinguished from this phenomenon because growing minor grains have a specific orientation depending on the texture of the primary recrystallization grains, while those of abnormal growth have a random orientation.

According to our studies abnormal grain growth originating from treatment for enhancing driving force is only limited within the area subjected to the treatment. Therefore, it was made clear that, since selectivity due to the texture of the primary recrystallization grains has a strong effect outside of this area, the grains having a random orientation can be never grown further.

This phenomenon is advantageous for the purpose of this invention, as will be further described hereinafter.

First, it is possible to control the size of the fine grains by controlling only the amount of strain and strain inducing area when a strain is induced into the steel sheet.

As shown in the foregoing experiment, for example, the size of the fine grains can be appropriately controlled when the treated area of induced strain, is present prior to secondary recrystallization, is limited to about 3 mm or less in diameter because the appropriate size of the fine grains penetrating the steel sheet is about 3 mm or less, expressed as the diameter of the corresponding circle.

Second, the fine grains artificially formed have an orientation that is largely deviated from the usual orientation of secondary recrystallization coarse grains, a Goss orientation ((110)[001]). Magnetic poles are therefore formed in high density at the grain boundaries between the secondary recrystallization coarse grains and fine grains, thereby making it possible to obtain good strain resistance and strong suppression effect for the building factor.

Generally speaking, spontaneously appearing fine grains may be formed during the production process of the grain-oriented electromagnetic steel sheet. However, their effects for improving the strain resistance and for suppressing the building factor are weak because the fine grains appearing are also secondary recrystallization grains that have been defeated in competition with other coarse secondary grains that have been spontaneously generated and have an orientation very close to the Goss orientation.

Third, the fine grains are artificially grown, so that they can be formed at most preferable sites in the product.

Since the artificially formed fine grains have an orientation that is considerably deviated from the Goss orientation, they should not be present in a high density in the product, i.e. it is preferable that they are dispersed as sparsely as possible, ideally as largely isolated as possible.

Such conditions can be readily realized by previously allowing formation of the strain inducing site locally and sparsely. An assembled state of several fine grains can be advantageously adapted if they exist inside the coarse crystal grains.

The results of investigations on the mechanism, in which such fine grains can be artificially obtained by applying a momentary high temperature heat treatment to the steel sheet after the decarburization—primary recrystallization annealing, will be described hereinafter.

The changes in the texture during secondary recrystallization annealing at the site on the steel sheet, where a momentary high temperature heat treatment has been applied, were studied.

The results showed that crystallographic changes such as grain diameter and precipitates were not significantly large and may be ignored immediately after the high temperature heat treatment. At an earlier stage of the secondary recrystallization annealing, however, it was observed that one primary recrystallization grain had been coarsened to 1.5 to 3.0 times as large as primary recrystallization grains around it. The temperature at which such coarsening of the grains occurs is much lower than the conventional secondary recrystallization temperature. Further, the time in which the grains are grown to penetrate the steel sheet is very short. After the penetration through the sheet along the direction parallel to its thickness, the grains rapidly grow in the region subjected to high temperature heat treatment, but thereafter the growth rate is so retarded even when temperature increase is continued, finally reaching cessation of this grain growth outside the region.

Normal nuclei of the secondary recrystallization grains are formed and continue to grow with the temperature increase at the non-treated site where high temperature heat treatment is not applied. However, the grains grown at the initial stage at the site where high temperature heat treatment has been applied are not invaded by the normal secondary recrystallization grains, finally being left in the product as fine grains.

We have discovered that such phenomenon arises from the mechanism below.

A prescribed amount of strains are already induced into each primary recrystallization crystal grain at the site where high temperature heat treatment has been applied. Although part of the strains is lost during the final finish annealing, a high density of dislocations remain in each crystal grain. This residual dislocations serve for enhancing the driving force of abnormal grain growth. When the driving force for the abnormal grain growth becomes sufficiently high, grains having a random orientation start to form nuclei and to grow by overcoming the selectivity of the orientation by the secondary recrystallization originating from the texture after the primary recrystallization. Since this phenomenon occurs due to a large driving force for the abnormal grain growth, it can start at a considerably lower temperature than the temperature for nuclei formation or grain growth of the ordinary secondary recrystallization that takes place in the non-treated area. However, the grains having a random orientation can not grow outside of the region where the driving force for the abnormal grain growth is enhanced, because orientation selectivity for the grain growth acts so strongly.

The orientation of the grains that cause abnormal grain growth at the region subjected to high temperature treatment is characterized by a random orientation since selectivity of the crystal orientation is relatively weak. However, the grains eventually belong to one kind of abnormally grown grains, so that it is inevitable that suppressing the growth of the primary recrystallization grains against the normal grains is present; therefore strong inhibitors are required.

Because the conventional methods (in which a special agent is coated or a high temperature and long time of heat treatment is applied) may result in coarsening of precipitated inhibitors or lowering of the inhibition force, abnormal grain growth hardly occur. Moreover, the methods are inappropriate since generation of many fine grains as a result of normal grain growth is induced. Accordingly, such a method essentially differs from the method according to this invention and should be avoided.

It was already mentioned that it is an essential condition that the driving force for the abnormal grain growth should be enhanced to a level exceeding the selectivity of grain orientation in the area where growth of the fine grains is intended, in order to cause the fine grains to artificially grow.

The driving forces for the abnormal grain growth are; (1) the presence of strains; (2) finely dividing the primary recrystallization grains and; (3) increase in superheating amont relative to the diameter of primary grains by intensifying the inhibition force of inhibitors. In method (3), however, generation of grains having a random orientation is difficult to control and grains having an orientation close to the Goss orientation often grow. The grains coarsely grow beyond the intended growth area for the fine grains, so that controlling the size of the grains becomes very difficult.

Accordingly, it is advantageous that (1) appropriate strains are present and (2) the size of the primary recrystallization grains is made small. Especially, the presence of strains is most advantageous.

The research results indicated that small crystallographic changes such as increase in the grain diameter and coarsening of precipitated inhibitors even at high temperatures and the presence of large amount of thermal strain advantageously enhance the driving force for the abnormal grain growth. In other words, it is the reason of the advantageous effect that only physical strains were made possible to be introduced into the steel sheet by rapidly increasing and decreasing the temperature while suppressing crystallographic structure changes. However, a slight increase in the number of nuclei formed and coarsening of the precipitated inhibitors are thought to be preferable so long as they do not reduce the driving force for the abnormal grain growth because they have a tendency to increase the number of nuclei for the abnormal grain growth and to uniformly limit the number of fine grains formed in the area.

Many methods for inducing physical strains into the steel sheet by suppressing crystallographic structure changes can be devised other than heat treatment. The methods developed by us and now considered to be most advantageous are a method comprising pressing solid bodies having small projections harder than the steel sheet onto the surface of the steel sheet, or applying a local electric current or electric discharge by impressing a high local electric voltage, or locally applying a pulse laser beam.

Among other methods for making the primary recrystallization grains fine, which leads to enhancing the driving force for the abnormal grain growth, the method in which the steel sheet is locally impregnated with carbon from its surface followed by making the grains fine by taking advantage of $\alpha$-$\gamma$ transformation of the crystal, was found especially effective.

Another effective method for emphasizing the inhibition effect of the inhibitor comprises locally impregnating the sheet with nitrogen from its surface to cause silicon nitride or aluminum nitride to be formed, locally enhancing the inhibition force. However, the stability of the effect achieved is low.

It is also possible to obtain fine grains to extinguish the effect of inhibitors by various methods. One example is to apply dotted coating spots of degradation compounds of inhibitors such as $MnO_2$ and $Fe_2O_3$ on the surface of the steel sheet.

Still more, it is possible to form dotted spots of fine grains by suppressing the growth of secondary recrystallization grains during final finish annealing by applying dotted coating spots of metals such as Mn or Sb on the surface of the steel sheet.

Some researches have been conducted concerning the fine grains in the crystal structure of the product. Japanese Examined Patent Publication No. 6-80172 discloses, for example, attempting to optimize the existence ratios of fine grains and coarse grains for the purpose of attaining minimum iron loss, wherein it was believed that the iron loss can be reduced by forming fine grains having a diameter of 1.0 mm or more and 2.5 mm or less into grains having a diameter of 5.0 mm or more and 10.0 mm or less as mixed grains. Japanese Examined Patent Publication No. 62-56923 discloses a method designed to reduce iron loss by limiting the number ratio of fine grains having a diameter of 2 mm or less to 15 to 70%.

However, these prior art procedures were developed at a time when the technique for finely dividing magnetic domains was not common and the method did not intend to aggressively enhance magnetic flux density. Therefore, the proper value of the mean grain diameter of the secondary recrystallization grains is radically smaller than the proper range according to this invention.

The fine grains in the prior art are only formed by promoting spontaneous formation of secondary recrystallization grains, and not formed artificially. Accordingly, their orientation is so close to the Goss orientation that the function for enhancing the strain resistant property and for improving the building factor of this invention is very weak indeed.

Japanese Unexamined Patent Publication No. 56-130454 discloses an art in which many recrystallization grains are linearly formed to reduce iron loss by finely dividing the magnetic domains by endowing the surface of the steel sheet with a strain and annealing. In this technique, the recrystallized grains consist of a group of many recrystallization grains having a diameter of as small as ½ or less of the thickness of the steel sheet. Because it is inevitable in this art to linearly distribute the fine grains along the transverse direction of the steel sheet for finely dividing the magnetic domains, a decrease in the magnetic flux density is caused, thus it is made impossible to obtain the same effect for improving the building factor and for increasing the strain resistance as obtained by the fine grains according to this invention.

On the contrary, the effect caused by the existence of the fine grains in the technique according to this invention makes it possible not only to decrease the iron loss value of the product but also to suppress the increase of the building factor caused by coarsening of the secondary recrystallization grains accompanied by making the magnetic flux density high, thereby the performance of the transformer is improved to a level comparable to the improvement of characteristics of the product.

The technology for artificially dividing the magnetic domains into fine width has been recently developed as an art for reducing the iron loss of a grain-oriented electromagnetic steel sheet by locally introducing linear local stress by irradiating with a plasma jet or laser beam, or by providing linear grooves on the surface of the steel sheet.

When such technology as described above is used in this invention together with the technology for finely dividing the magnetic domains, a much improved performance can be achieved.

We have intensively studied to improve the performance of a transformer or other practical device including the art for making the magnetic domains fine, and have found that it is important to limit the control factors for finely dividing the magnetic domains and for forming fine grains within a prescribed range for the purpose of effectively reflecting the material characteristics on the performance of the practical device.

These discoveries will be described in detail hereinafter.

While a grain-oriented electromagnetic steel sheet is mainly used for core materials of the transformer, the range of the magnetic flux density required varies depending on the design of the device in which it is used. Generally speaking, materials having a higher magnetic flux density are advantageously used under a higher magnetic flux density. Therefore, the materials are required to have a good performance of the practical device in the high magnetic flux density region.

As hitherto described, it is known in the art that the performance of the practical device made of a grain-oriented electromagnetic steel sheet having a high magnetic flux density tends to deteriorate in spite of good magnetic characteristics of the material. While grains constituting the electromagnetic steel sheet are inevitably coarsened when the material has a high magnetic flux density, the building factor can be advantageously reduced by changing the depths of grooves or the range of local stress depending on the grain diameter. In other words, the characteristics of the material can be reflected on the performance of the practical device.

Experiments carried out on this subject are described hereinafter.

A grain-oriented electromagnetic steel sheet having a composition comprising 0.08 wt % of C, 3.40 wt % of Si, 0.07 wt % of Mn, 0.025 wt % of Al, 0.018 wt % of Se, 0.040 wt % of Sb, 0.012 wt % of Ni, 0.004 wt % of Bi and 0.008 wt % of N (Bi containing steel) with a balance of Fe and inevitable impurities was subjected to hot band annealing at 750° C. for 3 seconds to adjust the content of carbide followed by pickling. After applying cold rolling with a reduction of 30%, the sheet was then subjected to soaking at 1050° C. for 45 seconds as an intermediate annealing and a heat treatment comprising rapid cooling at 40° C./s, followed by pickling again. A steel sheet having a final thickness of 0.22 mm was prepared by applying warm rolling at 150 to 200 C. with a reduction of 87%.

In a separate experiment, a grain-oriented electromagnetic steel sheet having a composition comprising 0.05 wt % of C, 3.20 wt % of Si, 0.15 wt % of Mn, 0.014 wt % of Al, 0.008 wt % of S, 0.005 wt % of Sb, 0.0005 wt % of B and 0.007 wt % of N (B containing steel) with a balance of Fe and inevitable impurities was subjected to hot band annealing at 800° C. for 30 seconds followed by pickling. A steel sheet having a final thickness of 0.34 mm was prepared by applying warm rolling at 170° C. with a reduction of 87%.

After applying a degreasing treatment to these steel sheets, both of Bi containing steel and the B containing steel were divided into 7 small coils symbolized a) to g) The following treatments were applied to each coil.

In the case of coil a), for finely dividing the magnetic domains, linear grooves having a depth of 25 $\mu$m and a width of 250 $\mu$m were provided on the surface of the steel sheet along a direction tilted by 10° from the transverse direction. They had a repeating distance of 3 mm. After applying decarburization and primary recrystallization annealing to the coil at 850° C. for 2 minutes, a momentary heat treatment was applied for several milliseconds by an electric discharge under a condition of applied energy of 65 Ws, wherein the heat treatment was applied as dotted spots having a diameter of 1.5 mm with a distribution of as sparse as 30 mm pitch along the transverse direction and 60 mm pitch along the longitudinal direction in the case of the Bi containing steel. In the case of the B containing steel, on the other hand, a momentary heat treatment was applied for several milliseconds by an electric discharge under a condition of applied energy of 65 Ws, wherein the heat treatment was applied as dotted spots having a diameter of 1.5 mm with a distribution of as dense as 15 mm pitch along the transverse direction and 30 mm pitch along the longitudinal direction.

In the case of coil b), for finely dividing the magnetic domains, linear grooves having a depth of 10 $\mu$m and a width of 50 $\mu$m were provided on the surface of the steel sheet along the direction tilted by 10° from the transverse direction with a pitch of 3 mm. After applying decarburization and primary recrystallization annealing at 850° C. for 2 minutes to the coil, a momentary heat treatment was applied for several milliseconds by an electric discharge under a condition of applied energy of 65 Ws, wherein the heat treatment was applied as dotted spots having a diameter of 1.5 mm with a distribution of as sparse as 30 mm pitch along the transverse direction and 60 mm pitch along the longitudinal direction in the case of the Bi containing steel. In the case of the B containing steel, on the other hand, a momentary heat treatment was applied for several milliseconds by an electric discharge under a condition of applied energy of 65 Ws, wherein the heat treatment was applied as dotted spots having a diameter of 15 mm with a distribution of as dense as 15 mm pitch along the transverse direction and 30 mm pitch along the longitudinal direction.

After applying decarburization and primary recrystallization annealing to the coils c) to e) at 850° C. for 2 minutes, momentary heat treatment was applied for several milliseconds by an electric discharge under a condition of applied energy of 65 Ws, wherein the heat treatment was applied as dotted spots having a diameter of 1.5 mm with a distribution of as sparse as 30 mm pitch along the transverse direction and 60 mm pitch along the longitudinal direction in the case of the Bi containing steel. In the case of the B containing steel, on the other hand, momentary heat treatment was applied for several milliseconds by an electric discharge under applied energy of 65 Ws, wherein the heat treatment was applied as dotted spots having a diameter of 1.5 mm with a distribution of as dense as 15 mm pitch along the transverse direction and 30 mm pitch along the longitudinal direction.

After applying decarburization and primary recrystallization annealing to the coil f) at 850° C. for 2 minutes, a momentary heat treatment was applied for several milliseconds by an electric discharge under a condition of applied energy of 65 Ws, wherein the heat treatment was applied as dotted spots having a diameter of 1.5 mm with a distribution of as dense as 15 mm pitch along the transverse direction and 30 mm pitch along the longitudinal direction in the case of the Bi containing steel. In the case of the B containing steel, on the other hand, a momentary heat treatment was applied for several milliseconds by an electric discharge under a condition of applied energy of 65 Ws, wherein the heat treatment was applied by dotted spots having a diameter of 1.5 mm with a distribution of as sparse as 30 mm pitch along the transverse direction and 60 mm pitch along the longitudinal direction.

Only a decarburization and primary recrystallization annealing at 850° C. for 2 minutes was applied to the coil g) as a comparative material.

After coating MgO supplemented with 10 wt % of $TiO_2$ and 2 wt % of $Sr(OH)_2$ as an annealing separator on the surface of the coils a) to g), the coils were wound up and subjected to final finish annealing.

A treatment for the purpose of secondary recrystallization was carried out in $N_2$ up to a temperature of 850° C. and in a mixed atmosphere of $H_2$ and $N_2$ up to a temperature of 1150° C., followed by keeping a treatment for the purpose of purification at a temperature of 1150° C. for 5 hours in the final finish annealing.

After final finish annealing, the unreacted annealing separator was eliminated and a tension coat comprising 50 wt % of colloidal silica and magnesium phosphate was applied.

In the case of coil c), a product was prepared after repeatedly irradiating with a plasma jet (PJ) having a width of 0.5 mm linearly along the transverse direction of the steel sheet with a repeating distance of 10 mm along the rolling direction for finely dividing the magnetic domains and to provide linear local stress areas.

In the case of coil d), a product was prepared after repeatedly irradiating a plasma jet (PJ) having a width of 1.5 mm linearly along the transverse direction of the steel sheet with a repeating distance of 3 mm along a direction parallel to the rolling direction for finely dividing the magnetic domains and to provide linear local stress areas.

Test samples were cut off from each product sheet and measurements were made of iron loss value of $W_{18/50}$ for the Bi containing steel (which was frequently used in a high magnetic field) and an iron loss value of $W_{15/50}$ for the B containing steel (which was frequently used in a low magnetic field).

Model transformers were produced from each product via slit processing, shear processing and lamination processing. The values of $W_{18/50}$ and $W_{15/50}$ were measured followed by a measurement of the grain diameter after macro-etching of the steel sheet.

Close attention was paid in the slit processing, shearing processing and lamination processing, not to cause excessive strain.

The experimental results are summarized in Table 3.

TABLE 3

| | | | Treatment for finely dividing magnetic domains | | Magnetic characteristics of product | | | Building factor of transformer | | Macro-crystalline structure of product | |
|---|---|---|---|---|---|---|---|---|---|---|---|
| Kind of steel | Treatment symbol | Distribution of discharge treatment | Kind | Condition | $B_8$ (T) | $W_{15/50}$ (W/kg) | $W_{18/50}$ (W/kg) | $W_{15/50}$ (W/kg) | $W_{18/50}$ (W/kg) | Number ratio of grains with a diameter of 3.0 mm or less (%) | Mean diameter of grains with a diameter of more than 3.0 (mm) |
| Bi containing steel | a | Coarse | Groove | 25 μm | 1.947 | 0.84 | 1.26 | 1.15 | 1.19 | 79.6 | 74.2 |
| | b | Coarse | Groove | 10 μm | 1.953 | 0.85 | 1.27 | 1.14 | 1.16 | 81.2 | 70.6 |
| | c | Coarse | P.J. | 10 mm | 1.965 | 0.86 | 1.22 | 1.15 | 1.16 | 80.3 | 86.4 |
| | d | Coarse | P.J. | 4 mm | 1.966 | 0.86 | 1.25 | 1.15 | 1.18 | 79.8 | 82.5 |
| | e | Coarse | No | — | 1.965 | 0.86 | 1.26 | 1.15 | 1.17 | 79.5 | 76.3 |
| | f | Dense | No | — | 1.963 | 0.88 | 1.22 | 1.14 | 1.16 | 92.3 | 92.6 |
| | g | No | No | — | 1.964 | 0.92 | 1.34 | 1.35 | 1.42 | 12.5 | 96.5 |
| B containing steel | a | Dense | Groove | 25 μm | 1.893 | 0.81 | 1.36 | 1.15 | 1.17 | 83.2 | 8.6 |
| | b | Dense | Groove | 10 μm | 1.901 | 0.83 | 1.36 | 1.18 | 1.16 | 82.6 | 8.9 |
| | c | Dense | P.J. | 10 mm | 1.923 | 0.83 | 1.34 | 1.18 | 1.17 | 86.5 | 9.7 |
| | d | Dense | P.J. | 4 mm | 1.925 | 0.85 | 1.33 | 1.15 | 1.17 | 83.6 | 10.3 |
| | e | Dense | No | — | 1.924 | 0.86 | 1.37 | 1.15 | 1.16 | 84.7 | 9.9 |
| | f | Coarse | No | — | 1.926 | 0.84 | 1.38 | 1.14 | 1.16 | 74.2 | 8.3 |
| | g | No | No | — | 1.925 | 0.88 | 1.42 | 1.37 | 1.21 | 2.5 | 10.5 |

As is evident from table 3, the coil f) having a higher number ratio of fine grains had a superior iron loss and building factor in the case of the Bi containing steel having high a $B_8$ value that is required to have a low iron loss of $W_{18/50}$ in a high magnetic field. When the number ratio of fine grains is low, the ion loss and building factor can be reduced by a complex effect caused by making the depth of the groove shallow (coil b) and the distance among the PJ irradiation regions long (coil c).

On the contrary, the coil f) having a lower number ratio of fine grains had a superior iron loss and building factor in the case of the B containing steel having a low $B_8$ value, which is required to achieve a low iron loss of $W_{18/50}$ in a high magnetic field. When the number ratio of fine grains is high, the ion loss and building factor can be reduced by a complex effect caused by making the depth of the groove deep (coil a) and the distance among the PJ irradiation regions short (coil d).

Magnetic characteristics of the material approximately depend on grain diameter. The grain diameter becomes larger in a high magnetic flux density material having better magnetic characteristics at high magnetic field. However, since fine grains having a grain diameter of smaller than 3 mm, which is characterized in this invention, included in coarse grains do not largely affect on the magnetic flux density of the material, they should be eliminated in consideration.

The mean grain diameter D (mm) of the crystal grains having a grain diameter of more than 3 mm, wherein the grains having a diameter of 3 mm or less among the grains constituting the steel sheet were omitted, was selected as a representative grain diameter for the characteristics of the flux density of the material and used as an index of the high magnetic field characteristics.

Based on the facts above, it was experimentally determined how the following range and area for obtaining a good building factor change depending on the D-values.

1) The range of proper volume density of the groove per unit area of the steel sheet;
2) The range of proper density of the area to be endowed with a local stress per unit area of the steel sheet;
3) The range of proper roughness on the surface of the steel sheet; and
4) The proper range of the crystal grain boundary steps (BS) in the crystal orientation emphasizing treatment.

The results obtained are shown in FIG. 4, FIG. 5, FIG. 6 and FIG. 7, which:

V represents a ratio of the volume of the grooves ($mm^3$) existing on a prescribed surface area of the steel sheet divided by the surface area ($mm^2$) of the steel sheet, i.e. the volume ratio (mm) of the grooves to the unit surface area of the steel sheet; S represents the area ($mm^2$) endowed with local stresses on a prescribed surface area of the steel sheet divided by the surface area of the steel sheet, i.e. the total area ratio S (dimensionless) of the local stress region per unit surface area of the steel sheet; Ra represents a mean roughness ($\mu$m) of the metal surface after removing the non-metallic coating film on the steel sheet; and BS represents a boundary step ($\mu$m) on the surface of the steel sheet generated at grain boundaries when a crystal orientation emphasizing treatment was applied.

Bm was calculated by the formula Bm=0.2×log D+1.4 using the D value heretofore described that represents the mean diameter of the grains constituting the steel sheet from which grains having a diameter of 3 mm or less have been omitted. The building factor was obtained by measuring the iron loss of the transformer corresponding to Bm calculated.

As is evident from FIG. 4, FIG. 5, FIG. 6 and FIG. 7, the building factor of the grain-oriented electromagnetic steel sheet can be further improved from the following range corresponding to the mean diameter D of the grains having a diameter of more than 3 mm.

(1) The range where the total volume ratio V (in mm unit) of the grooves satisfies the relation in equation (1);

$$log_{10}V \leqq -2.3-0.01\times D \quad (1)$$

(2) The range where the area ratio S of local stresses to the surface area of the steel sheet satisfies the relation in equation (2);

$$log_{10}S \leqq 0.7+0.005\times D \quad (2)$$

(3) The range where the mean roughness Ra of the boundary surface between the surface of the base metal and non-metallic coating film satisfies the relation in equation (3);

$$Ra \leqq 0.3-0.1\times log_{10}D \quad (3), \text{ or}$$

(4) The range where the mean grain boundary step BS after applying a crystal orientation emphasizing treatment on the surface of the steel sheet satisfies the relation in equation (4);

$$BS \leqq 3.0-log_{10}D \quad (4)$$

As discussed above, a combination of forming fine grains and finely dividing the magnetic domains not only favorably decreases the iron loss value of the product, but also favorably improves the performance of the transformer to an extent comparable to the improvement of the material characteristics by effectively suppressing increase of the building factor ascribed to coarsening of the secondary recrystallization grains as a result of making the magnetic flux density high.

In accordance with this invention it is preferable that S satisfies the following formula;

$$BS \leqq 3.0-log_{10}D \quad (4)$$

providing more advantageous improvement of strain resistant property and performance, as well as iron loss characteristics, of the practical device, wherein;

V (in mm unit) is the value of [(cross sectional area of the groove)×(total volume ($mm^3$) corresponding to the number of the grooves)] divided by the surface area ($mm^2$) of the steel sheet in concern;

S (dimensionless) is the value of [(width of linear local stress)×(length)×(total area ($mm^3$) of the local stress area corresponding to the number of linear local stresses)] divided by the total surface area ($mm^3$) of the steel sheet concerned;

Ra is the value ($\mu$m) of mean roughness measured along the central line of the metallic surface of the steel sheet; and BS is the boundary step ($\mu$m) generated at the crystal grain boundaries when a crystal orientation emphasizing treatment is applied on the surface of the steel sheet.

The components and preparations in accordance with this invention will be described in more detail hereinafter.

First, the reason why the composition of the electromagnetic steel sheet according to this invention is limited contents of elements will be described.

Si: About 1.5 to 7.0 wt %

Si is an effective component for increasing the electric resistance and decreasing the iron loss, so that its content is made to be about 1.5 wt % or more. However, since the content of more than about 7.0 wt % makes the steel sheet so hard that production or processing becomes difficult, thereby the content is limited in the range of about 1.5 to 7.0 wt %.

Mn: About 0.03 to 2.5 wt %

Mn also have an effect to increase electric resistance like Si and makes the hot press processing during the production process easy. Therefore, the element should be contained at least about 0.03 wt %. However, since γ-transformation of the metal is induced to deteriorate the magnetic characteristics when the content exceeds about 2.5 wt %, its content should be in the range of about 0.03 to 2.5 wt %.

C: About 0.003 wt % or Less, S: About 0.002 wt % or Less, N: About 0.002 wt % or Less All of C, S and N have a harmful effect on the magnetic characteristics, especially deteriorate the iron loss. Therefore, the contents of C, S and N are limited within about 0.003 wt % or less, about 0.002 wt % or less and about 0.002 wt % or less, respectively.

In producing the electromagnetic steel sheet, inhibitor components other than the elements described above are essential for inducing secondary recrystallization. Inhibitor components such as Al, B, Bi, Sb, Mo, Te, Se, S, Sn, P, Ge, As, Nb, Cr, Ti, Cu, Pb, Zn and In are advantageously adopted. These elements may be incorporated alone or in combination.

Next, the reason why the grains constituting the steel sheet are limited is described.

The crucial grains in this invention are those penetrating or embedded in the steel sheet along the direction parallel to its thickness, because such penetrating grains can create many magnetic poles at the grain boundary, and a large increase in magnetostatic energy can be estimated.

The grain diameter in this invention is represented by the diameter of a circle (diameter corresponding to a circle) having the same area of the grains on the surface of the steel sheet. The mean diameter of the grain is a value corresponding a circle in which the total area of the grains is divided by the number of grains contained in a unit area.

For the purpose of obtaining a grain-oriented electromagnetic steel sheet having a good strain resistant property and being excellent in performance of a practical device such as transformer in accordance with this invention, it is an essential condition that the ratio of the numbers of grains having a grain diameter of about 3 mm or less is about 65% or more and about 98% or less. This is because, when the number ratio of the crystal grains having a grain diameter of about 3 mm or less is less than about 65%, an effect increasing the magnetostatic energy due to the presence of the fine grains cannot be obtained, and deterioration of the strain resistant property and increase of the building factor are caused, thereby deteriorating the iron loss of the transformer. When the number ratio of the grains having a grain diameter of about 3 mm or less is over about 98%, on the other hand, the magnetic flux density of the product is decreased and the iron loss is deteriorated. As for the number ratio of the fine grains, a remarkable reduction effect on the building factor and improvement effect on the strain resistant property is observed.

While spontaneously generated fine crystals can be used for the fine grains having a diameter of about 3 mm or less, it is more preferable that the fine crystal grains are artificially and regularly disposed in the steel sheet so that the magnetic poles present at the grain boundaries are uniformly distributed in the steel sheet, i.e. the distribution of the magnetostatic energy is made uniform. This allows the magnetic flux flow to be even and iron loss increasing phenomenon by which eddy current loss is locally and abnormally increased can be suppressed.

Figure 8:
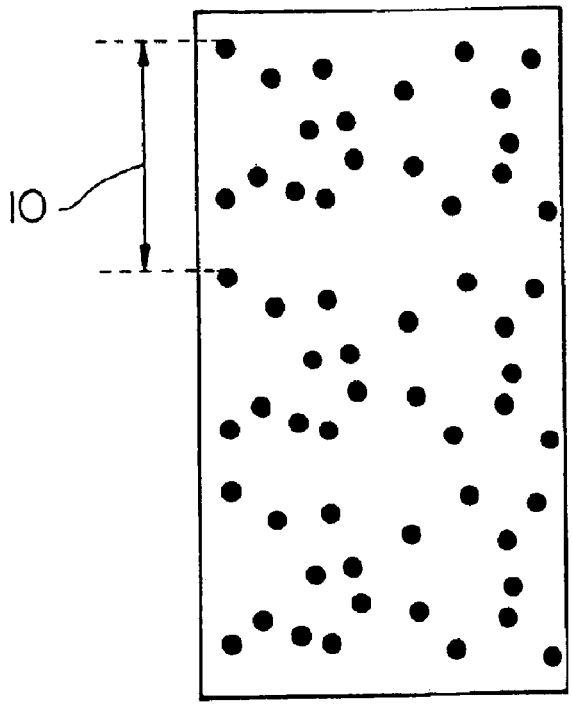
FIG. 8 is an illustration of an area where the driving force for the abnormal grain growth is enhanced and is sparsely spaced on the surface of the steel sheet.

It is effective, for the area where fine grains are generated, that the area is sparsely distributed as shown in FIG. 8. Since a uniform distribution of the area little damaging effect to decrease the magnetic flux density and beneficially reduces susceptibility to strain, it is naturally more effective to cause such area to be artificially and regularly disposed for obtaining an excellent effect, than to allow it to be randomly distributed.

Figure 11:
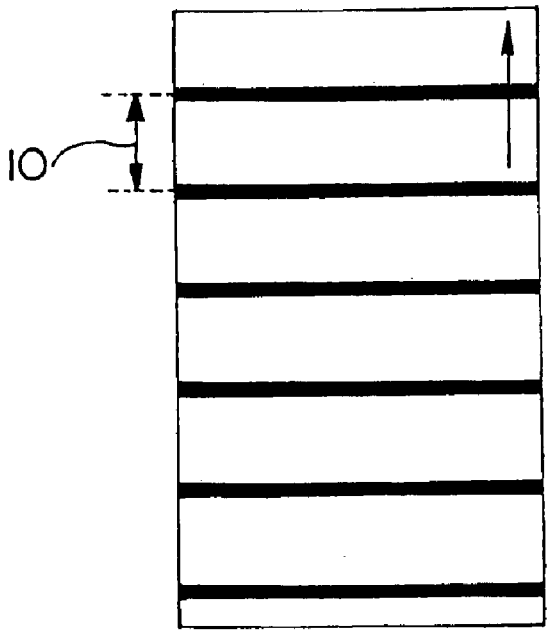
FIG. 11 is an illustration of an alternative form of the invention for linearly elongating the pattern of artificial crystal grains.

When linearly extending artificial grains have been grown as shown in FIG. 11, for example, a large amount of deterioration of flux density of the product was caused and the iron loss was unexpectedly increased.

It is preferable that the distance among the sparsely dispersed fine grains is 5 mm or more. In FIGS. 8 to 11, 9 is the roll direction, 10 is a repeating distance of the treatment along the roll direction for enhancing the driving force for the abnormal grain growth, and 11 is a repeating distance of the treatment along the direction perpendicular to the roll direction for enhancing the driving force for the abnormal grain growth.

It is preferable that the mean grain diameter of the grains in the steel sheet is about 8 mm or more and about 50 mm or less. This is because, when the mean grain diameter is less than about 8 mm, it is difficult to constantly obtain a good iron loss value because lowering of the alignment of the crystal orientation, that is, decrease of magnetic flux density may occur while, when the mean grain diameter is more than about 50 mm, the building factor and strain resistance factor are often deteriorated.

As described above, a grain-oriented electromagnetic steel sheet having a high magnetic flux density, low iron loss and excellent strain resistance and performance of the practical device can be obtained by creating fine grains having a diameter of about 3 mm or less together with coarse grains having a diameter of about 15 mm or more in the steel sheet. However, a treatment for finely dividing the magnetic domains can be advantageously applied for the purpose of further lowering the iron loss characteristics.

Accordingly, treatments such as introducing linear local stress, forming linear grooves, smoothing of the surface and emphasizing the grain orientation are used together in this invention as techniques for finely dividing the magnetic domains.

According to our studies the techniques for finely dividing the magnetic domains described above are closely related to the grain size of the steel sheet, especially the mean grain diameter of the grains that have a diameter of more than about 3 mm, and the appropriate range of the techniques depend on the mean grain diameter.

Provided that, among the grains constituting the steel sheet, the mean diameter of the grains that penetrate the steel sheet along the direction parallel to its thickness and have a grain diameter larger than 3 mm is D (mm), it is preferable that the value substantially satisfies any one of the following relations;

(1) the total volume ratio V (in mm unit) of the grooves that have been repeatedly provided along the rolling direction per unit area of the steel sheet is in a range satisfying the relation in equation (1);

$$log_{10}V \leqq -2.3-0.01\times D \quad (1)$$

(2) the total area ratio S (dimensionless) of local stresses region that have been repeatedly provided along the rolling direction per unit area of the steel sheet is in a range satisfying the relation in equation (2);

$$log_{10}S \leqq -0.7+0.005\times D \quad (2)$$

(3) the mean roughness Ra of the boundary surface between the surface of the base metal and non-metallic coating film is in a region satisfying the relation in equation (3);

$$Ra \leqq 0.3-0.1\times log_{10}D \quad (3), \text{ or}$$

(4) the mean grain boundary step BS after applying a crystal orientation emphasizing treatment on the surface of the steel sheet is in a region satisfying the relation in equation (4);

$$BS \leqq 3.0-log_{10}D \quad (4)$$

More advantageous improvements not only in iron loss but also in strain resistance and performance of the practical device are realized by the conditions described above:

wherein;

V (in mm unit) is the value of [(cross sectional area of the groove)×(total volume ($mm^3$) corresponding to the number of the grooves)] divided by the surface area ($mm^2$) of the steel sheet in concern;

S (dimensionless) is the value of [(width of linear local stress region)×(length)×(total area ($mm^2$) of the local stress area corresponding to the number of the linear local stress)] divided by the total surface area ($mm^2$) of the steel sheet in concern;

Ra is the value ($\mu$m) of mean roughness measured along the central line of the metallic surface of the steel sheet; and BS is a boundary step ($\mu$m) generated at the grain boundaries when crystal orientation emphasizing treatment is applied on the surface of the steel sheet.

Any method known in the art for forming grooves, such as etching the surface of the steel sheet and forming the grooves by pressing a geared roll on the surface of the steel sheet; or for introducing local stresses such as pressing with a rotating body, irradiating with a laser or plasma jet can be suitably adopted.

Any method for smoothing the interface between the steel sheet and a non-metallic coating film, such as suppressing the formation of a forsterite coating film, or reducing the roughness on the surface of the steel sheet by a method such as pickling, polishing, or chemical polishing or grinding after removing the forsterite coating film, can be suitably adopted.

The crystal orientation emphasizing treatment is a method in which, after suppressing the formation of a forsterite coating film or removing the forsterite coating film, the surface of the steel sheet is subjected to electrolysis in an aqueous solution of a halogenated compound to allow a crystallographic face having a specific orientation to preferentially remain. This method also is suitably adopted in this invention.

Although the fine grains not penetrating through the steel sheet along the direction parallel to its thickness have little effect according to this invention, they do have an effect for finely dividing the magnetic domains. It is preferable that the number of the fine grains not penetrating through the steel sheet along the direction parallel to the thickness of the steel sheet are at least four times as numerous as those penetrating the steel sheet.

This grain-oriented electromagnetic steel sheet is used by coating its surface with an insulator. The insulating film may be a film mainly containing forsterite ($Mg_2SiO_4$) formed by final finish annealing, or a tension film may be coated on the former film.

A method for producing a grain-oriented electromagnetic steel sheet according to this invention is described hereinafter.

The reason why the compositions of the starting steel are limited is as follows:

C: About 0.010 to 0.120 wt %

When the content of C is less than about 0.010 wt %, an effect for improving the texture is not obtained and the magnetic characteristics are deteriorated by an imperfect secondary recrystallization. When the content is more than about 0.120 wt %, on the other hand, C cannot be eliminated by decarbonation annealing and the magnetic characteristics are also deteriorated. Therefore, the content of C is limited within about 0.010 to 0.120 wt %.

Si: About 1.5 to 7.0 wt %

Si is an effective component for increasing the electric resistance and decreasing iron loss, so that its content is made to be about 1.5 wt % or more. However, since the content of more than about 7.0 wt % makes the steel sheet so hard that production or processing becomes difficult, the content is limited in the range of about 1.5 to 7.0 wt %.

Mn: About 0.03 to 2.5 wt %

Mn also has an effect to increase electric resistance like Si and makes the hot rolling processing during the production process easy. Therefore, the element should be contained at least about 0.03 wt %. However, since $\gamma$-transformation of the metal is induced to deteriorate the magnetic characteristics when the content exceeds about 2.5 wt %, its content should be in the range of about 0.03 to 2.5 wt %.

It is essential that inhibitor components are contained in the steel other than the elements described above to induce secondary recrystallization. The preferable inhibitor components suitable for producing a grain-oriented electromagnetic steel sheet having a high magnetic flux density include one, or two or more of the elements selected from Al, B, Bi, Sb and Te.

The elements Al, Sb and Te should be contained in the range of about 0.005 to about 0.060 wt %, about 0.0003 to about 0.0025 wt % and about 0.0003 to about 0.0090 wt %, respectively, because, when the content of either such element is less than its lower limit, a growth inhibition effect for the primary recrystallization grains expected as an inhibitor can not be attained while, when the content is more than its upper limit, the surface property of the product is deteriorated due to the occurrence of cracks at grain boundaries.

Another inhibitors known in the art are Se, S, Sn, P, Ge, As, Nb, Cr, Ti, Cu, Pb, Zn and In. These inhibitors can be appropriately added in the range of about 0.005 to 0.3 wt %. While these inhibitors can display their effect by adding either of them alone, it is more preferable to add them in combination.

The other elements are not always necessary for obtaining a high flux density. However, since Mo has an effect to improve the surface condition of the steel sheet, it is advantageous to use it.

In the method, the steel piece adjusted to a desired suitable composition is processed to a steel sheet having a final thickness by applying, after forming a hot band steel sheet by a hot rolling method known in the art and, if necessary, the hot band annealing, once or twice or more of cold rolling with intermediate annealing.

The orientation of the grain grown in the secondary recrystallization is controlled during the final cold rolling by adjusting its reduction. When the reduction is less than about 80%, a high magnetic flux density cannot be sometimes obtained since many grains having a not so good orientation tend to be recrystallized while, when the ratio is more than about 95%, the probability of forming nuclei of the crystal grains is extremely decreased, causing unstable secondary recrystallization. Accordingly, the reduction of the final cold rolling should be preferably about 80 to 95%.

A combination of a warm rolling and inter-pass aging treatment during the rolling described above is advantageous for further improving the magnetic flux density.

It is also possible to apply weak decarburization during the hot band annealing and intermediate annealing.

When linear grooves are utilized as a treatment for finely dividing the magnetic domains, it is preferable that the linear grooves are provided on the surface of the steel sheet after final cold rolling.

When primary recrystallization annealing is applied, this treatment also serves as a decarburization treatment, if necessary, to reduce the content of C below a prescribed level.

As a most important technique according to this invention, the areas where the driving force for the abnormal grain growth are enhanced are locally provided during the time between midway in the primary recrystallization annealing step and the start of the secondary recrystallization.

Since grain growth along the direction parallel to the sheet thickness can relatively easily take place, it is not always necessary that such region is uniformly provided in the entire width of the sheet along the direction parallel to the thickness of the steel sheet. The effect is equal even when a part of the region along the direction parallel to the thickness of the sheet is provided with such region.

This area should have a projection area on the surface of the steel sheet corresponding to a circle having a diameter of 0.05 mm or more and 3.0 mm or less. When the diameter is less than 0.05 mm, the area is often invaded by later generating secondary recrystallization grains and finally disappears. When the diameter is more than 3.0 mm, on the other hand, the size of the fine grains formed also exceeds 3.0 mm causing a decrease of the magnetic flux density and an increase of iron loss.

Accordingly, it is necessary that the region subjected to such treatment shall have a narrow area of 3.0 mm or less in its diameter. When the treatment is applied to the elongated area, grains having an inferior orientation are formed, thereby causing a large decrease of magnetic flux density of the material and an increase of iron loss.

If the timing to provide such area in the production process were before the start of primary recrystallization, it would not be effective since the area is extinguished by the formation of the primary recrystallization crystal grains. When the timing is after the start of the secondary recrystallization, on the other hand, it is not effective because the fine grains are also distinguished by being invaded by the secondary recrystallization crystal grains without any time for nucleus formation and grain growth.

As described previously, the method for enhancing the driving force for the abnormal grain growth ate:

(1) introducing strain;

(2) finely dividing the primary recrystallization crystal grains; and (3) intensifying the inhibition force of inhibitors.

Among these methods,(1) and (2) are superior; method (1) is especially excellent for artificially generating the fine grains and controlling them.

The preferable amount of strain to be introduced into the steel sheet is in the range of about 0.005 to 0.70 because, when the amount is less than about 0.005, the effect of strain would be unstable since sometimes formation of fine grains does not start while, when the amount is more than 0.70, many fine grains so strongly tend to be formed at the same site that the effect is weak compared with the effort for inducing the strain.

Figure 13:
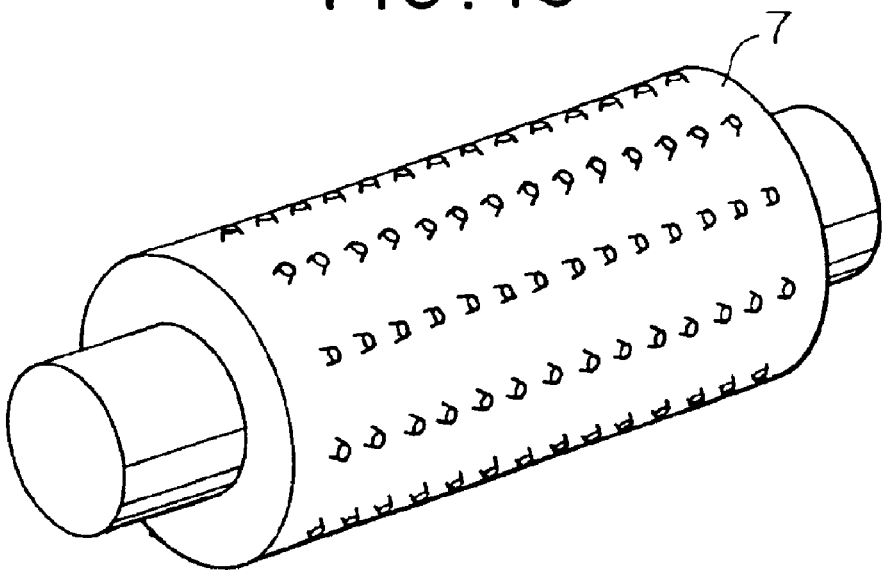
FIG. 13 is a perspective view of a roll having many projections on its surface for treatment of a steel sheet.
Figure 14:
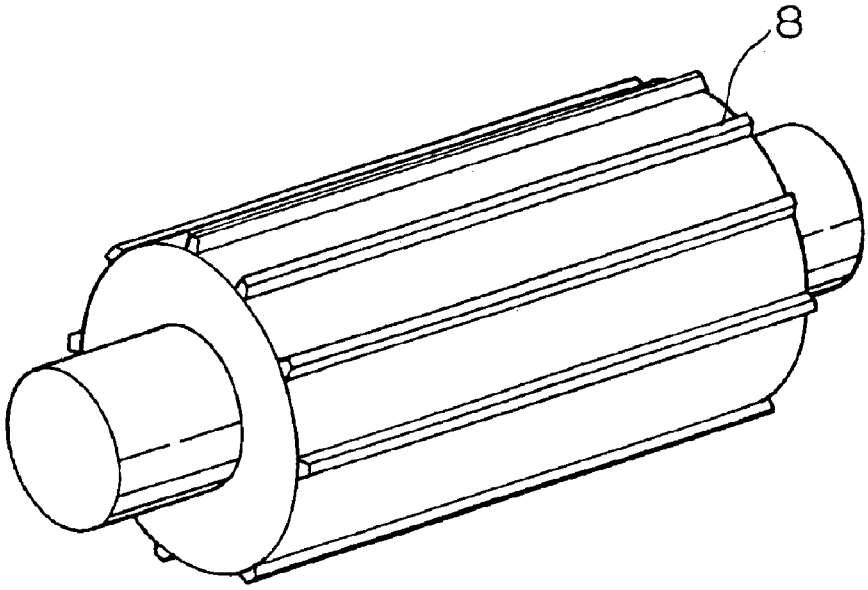
FIG. 14 is a perspective view of a roll having linear projections on its surface for that purpose.

Especially excellent method for industrially providing a region where the driving force for the abnormal grain growth is enhanced with high efficiency and stability comprises; press-rolling the surface of the steel sheet with an object having many projections on its surface and harder than the steel sheet as shown in FIG. 13; or imposing an electric is current or electric discharge by impressing a high voltage between the surface of the steel sheet and an electrode as shown in FIG. 14; or momentary irradiating a high temperature spot laser; or locally irradiating a pulse laser.

The high temperature spot laser to be used in this invention is a continuously emitting large capacity laser such as a carbon dioxide laser, which locally irradiates and heats the surface of the steel sheet for a short time of several hundred milliseconds. The pulse laser can locally give a very strong impact force on the surface of the steel sheet with a high density light flux for a very short time using a Q-switch.

Another method for enhancing the driving force for the abnormal grain growth is to finely divide the primary recrystallization crystal grains, wherein it was found possible to locally divide into fine grains by taking advantage of an $\alpha$-$\gamma$ transformation during heat treatment after locally impregnating the steel sheet with carbon applied to and impregnated from its surface.

A method for intensifying the inhibition force of the inhibitor comprises locally impregnating the steel sheet with nitrogen from its surface to form silicon nitride or aluminum nitride, thereby locally enhancing the inhibition force.

It is possible to obtain fine grams by extinguishing the effect of inhibitors by a variety of means other than those described above, for example by forming dotted coating spots of inhibitor degradation compounds such as $MnO_2$ and $Fe_2O_3$ on the surface of the steel sheet.

It is also possible to generate dotted spots of fine grains by suppressing growth of the secondary recrystallization grains during the final finish annealing by applying or coating dotted spots of metallic Sn and/or Sb on the surface of the steel sheet.

After artificially providing the area where the driving force for the abnormal grain growth is enhanced, the secondary recrystallization is achieved by applying a final finish annealing after coating the steel sheet with an annealing separator, if necessary. The temperature for the final finish annealing may be increased up to around about 1200° C. for purification annealing and to form a base coat of the forsterite material.

An insulating coating is then applied on the surface of the steel sheet to form the product. The surface of the steel sheet may be finished into a mirror surface or be subjected to a crystal orientation emphasizing treatment, or a tension coating may be applied as an insulation coating.

Another allowable method for suppressing generation of fine grains is to anneal at a temperature of more than about 700° C. after applying dotted strains on the surface of the steel sheet.

The appropriate strain area has a diameter of about 0.1 to about 4.5 mm because, when the area is less than about 0.1 mm, the strain is eliminated before recrystallization during the succeeding annealing at a temperature of about 700° C., so that it is made impossible to generate fine grains of a diameter of about 3 mm or less while, when the diameter is more than about 4.5 mm, the magnetic flux density will be deteriorated because the diameter of the freshly recrystallized crystal grains exceeds about 3 mm.

While freshly recrystallized fine grains can be obtained by applying strains to this area followed by annealing, an annealing temperature of about 700° C. or more is necessary for this purpose because, at a temperature less than about 700° C., not only the freshly recrystallized crystal grains are not generated but also strains remain in the steel sheet, thereby deteriorating the magnetic characteristics of the product.

Annealing for baking the insulation coating can be also used for annealing at about 700° C. or more.

A treatment for finely dividing the magnetic domains known in the art, for example applying a plasma jet or laser irradiation to the linear area or providing a linear grooves by a projection roll, can be applied to the steel sheet after secondary recrystallization for obtaining a further improved iron loss reduction.

When a plasma jet or laser irradiation is used for finely dividing the magnetic domains, a prescribed treatment may be applied on the surface of the steel sheet after secondary recrystallization. Linear grooves can be also provided at this stage.

When a boundary surface smoothing treatment or a crystal orientation emphasizing treatment is utilized, it is suitable to suppress the formation of the forsterite coating film or to apply an insulating coating by proper treatment after eliminating the forsterite coating film.

A grain-oriented electromagnetic steel sheet having a low iron loss and excellent strain resistance and performance of the practical device can be obtained by the production method described above. Especially, when fine grains having a diameter of about 3 mm or less are present together with coarse grains having a diameter of about 15 mm or more, the product will be high in magnetic flux density and low in iron loss. Thereby an excellent transformer having a very low iron loss of the practical device can be assembled.

EXAMPLES

Example 1

Figure 12:
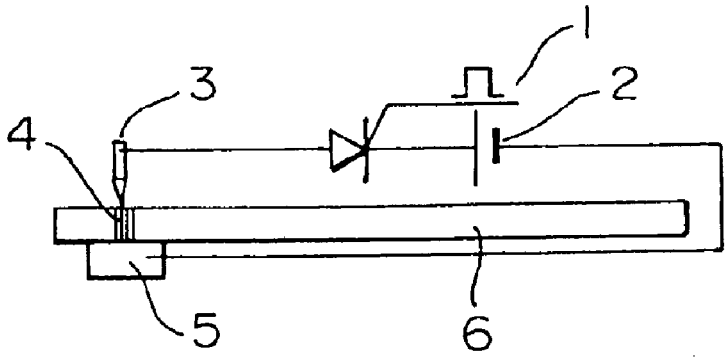
FIG. 12 is an outline of an apparatus for locally heating a steel sheet by an electric current or by an electric discharge.

After heating a steel slab comprising 0.08 wt % of C, 3.35 wt % of Si, 0.07 wt % of Mn, 0.02 wt % of Al, 0.05 wt % of Sb and 0.008 wt % of N with a balance of Fe and inevitable impurities at 1410° C., the slab was processed into a hot band steel sheet having a thickness of 2.2 mm by a conventional method. The hot band was then cold rolled to a thickness of 1.5 mm after a hot band annealing at 1000° C. for 30 seconds followed by pickling. After applying an intermediate treatment at 1080° C. for 50 second, the thickness of the sheet was finally adjusted to 0.22 mm by a warm rolling at a temperature of the steel sheet of 220° C. After a degreasing treatment and decarburization annealing at 850° C. for 2 minutes, the steel sheet was divided into two pieces. One piece was coated with an annealing separator containing MgO as a main component (Comparative Example). With respect to the other piece, a momentary electric discharge treatment at a voltage of 1 kV was applied to the areas on the steel sheet having a diameter of 1.5 mm using an apparatus as shown in FIG. 12 as a driving force enhancing treatment for the abnormal grain growth. After repeatedly providing such areas in a pattern shown in FIG. 11 with a pitch of 10 mm along the longitudinal direction of the coil and a pitch of 15 mm along the transverse direction, an annealing separator containing MgO as a main component was coated on the sheet (Example). In FIG. 12, 1 is a gate pulse determining the time of treatment, 2 is a high voltage mains, 3 is an electrode, 4 is the treatment area for enhancing the driving force of the growth of abnormal grain growth, 5 is a opposed electrode and 6 is a steel sheet.

As a final finish annealing, the coil obtained was heated in an $N_2$ atmosphere at a heating speed of 30° C./h up to a temperature of 850° C. and, after keeping at 850° C. for 25 hours, the coil was heated in a mixed gas atmosphere comprising 25% of $N_2$ and 75% of $H_2$ at a heating speed of 15° C./h up to a temperature of 1200° C. After keeping the temperature for 5 hours in a $H_2$ atmosphere, the temperature was decreased.

The unreacted annealing separator was removed from the coil and a tension coating agent containing 50% of colloidal silica was coated on the coil with baking. A product was produced by applying a treatment for finely dividing the magnetic domains with a plasma jet.

The plasma jet was linearly irradiated along the transverse direction of the sheet with a irradiation width of 0.05 mm and repeating distance along the roll direction of 5 mm.

A slit processing, shear processing and fixed lamination processing were applied to the steel sheet to produce two 3-phase transformers having a dimension of 250 mm in leg width, 900 mm in height and 300 mm in thickness. One of the transformers was produced under as little strain as possible while the other transformer was produced by purposely giving strain by pressing a caster carrying a spherical body with a diameter of 50 mm on the coil at a load of 5 kg, for experimentally evaluating the effect of strain.

The results of measurements of the iron loss characteristics and building factor are listed in Table 4 together with the results of studies on the magnetic characteristics of the material.

The number ratio of the grains having a diameter of 3 mm or less was determined by a macro-etching of the material and the mean diameter D of the crystal grains having a diameter of 3 mm or more was calculated. The results are also listed in Table 4.

TABLE 4

| | Magnetism of product | | Macro-structure of product | | | | | |
|---|---|---|---|---|---|---|---|---|
| | | | Number ratio | | | | | |
| | Magnetic | | of fine grains | Mean diameter | Iron loss of transformer $W_{17/50}$ | | | |
| Grain growth driving | flux density | Iron loss | with a diameter of 3 | of grains with a diameter of | Non-strain processing | | Strain processing | |
| force enhancing treatment | $B_8$ (T) | $W_{17/50}$ (W/kg) | mm or less (%) | more than 3 mm D (mm) | (W/kg) | Building factor | (W/kg) | Building factor |
| Yes (Example of this invention) | 1.978 | 0.673 | 89.5 | 17.3 | 0.787 | 1.17 | 0.794 | 1.18 |
| Non (Comparative example) | 1.982 | 0.672 | 23.2 | 34.7 | 0.860 | 1.28 | 1.062 | 1.58 |

As is evident from Table 4, the transformer produced by using the grain-oriented electromagnetic steel sheet according to this invention had a low building factor and was quite excellent in strain resistance indicating that the steel sheet was very excellent as an iron core material of a practical transformer.

Example 2

After heating a steel slab comprising 0.08 wt % of C, 3.35 wt % of Si, 0.07 wt % of Mn, 0.02 wt % of Al, 0.005 wt % of Bi and 0.008 wt % of N with a balance of Fe and inevitable impurities at 1400° C., the slab was processed into a hot band having a thickness of 2.6 mm by a conventional method. The hot band was then warm rolled to a final thickness of 0.34 mm with a steel sheet temperature of 250°

C. after a hot band annealing at 1100° C. for 30 seconds followed by pickling. After a degreasing and decarburization annealing at 850° C. for 2 minutes, the steel sheet was divided into two pieces. One piece was coated with a annealing separator containing MgO as a main component without any additional treatment (Comparative Example). Sn was adhered to the areas having a diameter of 0.1 to 2.0 mm on the surface of the steel sheet of the other piece to suppress the growth of the secondary recrystallization grains. Adhering of Sn was carried out by scattering fused droplets of Sn on the surface of the steel sheet. An annealing separator containing MgO as a main component was also coated on the sheet (Example).

As a final finish annealing, the coil obtained was heated in an $N_2$ atmosphere at a heating speed of 30° C./h up to a temperature of 850° C. and then heated in a mixed gas atmosphere comprising 25% of $N_2$ and 75% of $H_2$ at a heating speed of 15° C./h up to a temperature of 1200° C. After keeping the temperature for 5 hours in a $H_2$ atmosphere, the temperature was decreased.

The unreacted annealing separator was removed from the coil and a tension coating agent containing 50% of colloidal silica was coated on the coil with baking. A product was produced by applying a treatment for finely dividing the magnetic domains with a plasma jet.

Slit processing, shear processing and fixed lamination processing were applied to the steel sheet to produce two 3-phase transformers having a dimension of 300 mm in leg width, 1100 mm in height and 250 mm in thickness. One of the transformers was produced under a as little strain as possible while the other transformer was produced by purposely giving strain, by pressing a caster carrying a spherical body with a diameter of 50 mm on the coil at a load of 5 kg, for experimentally evaluating the effect of strain.

The results of measurements of the iron loss characteristics and building factor are listed in Table 5 together with the results of studies on the magnetic characteristics of the material.

The number ratio of the grains having a diameter of 3 mm or less was determined by a macro-etching of the material and the mean diameter D of the grains having a diameter of 3 mm or more was calculated. The results are also listed in Table 5.

TABLE 5

| | Magnetism of product | | Macro-structure of product | | Iron loss of transformer $W_{17/50}$ | | | |
|---|---|---|---|---|---|---|---|---|
| Primary grain coarsening | Magnetic flux | Iron loss | Number ratio of fine grains with a diameter | Mean grain | Non-strain treatment | | Strain treatment | |
| treatment by dotted discharge | density $B_8$ (T) | $W_{17/50}$ (W/kg) | of 3 mm or less (%) | diameter (mm) | (W/kg) | Building factor | (W/kg) | Building factor |
| Yes (Example) | 1.983 | 1.073 | 86.5 | 17.3 | 1.245 | 1.16 | 1.255 | 1.17 |
| Non (Comparative example) | 1.984 | 1.066 | 14.7 | 38.6 | 1.354 | 1.27 | 1.354 | 1.63 |

As is evident from Table 5, the transformer produced by using the grain-oriented electromagnetic steel sheet according to this invention had a low building factor and was quite excellent in strain resistance indicating that the steel sheet was very excellent as a iron core material of the practical transformer.

Example 3

After heating the steel slab having a composition shown in Table 6 at 1430° C., a hot band having a thickness of 2.6 mm was produced by a conventional method. After hot band annealing at 1000° C. for 30 seconds followed by pickling, an intermediate treatment was applied at 1050° C. for 50 seconds. The steel sheet was finally processed to a thickness of 0.26 mm by warm rolling at 230° C. After a degreasing treatment, grooves having a width of 50 $\mu$m and a depth of 25 $\mu$m were linearly provided with a tilt angle of 15° from the transverse direction of the coil and a repeating pitch of 4 mm along the longitudinal direction of the coil, and decarburization annealing was applied to the coil at 850° C. for 2 minutes.

The steel sheet was divided into two pieces and on one was coated with an annealing separator containing MgO as a main component without any additional treatment (Comparative Example).

Inhibition force promoting areas were formed by adhering $Fe_2O_3$ powder to the areas having a diameter of 1.5 mm on the surface of the other piece of the steel sheet. Such area was provided with a pitch of 5 mm along longitudinal direction of the coil and a pitch of 10 mm along the transverse direction of the coil. An annealing separator containing MgO as a main component was also coated on the coil (Example).

As a final finish annealing, the coil obtained was heated in $N_2$ atmosphere at a heating speed of 30° C./h up to a temperature of 850° C. and then heated in a mixed gas atmosphere comprising 25% of $N_2$ and 75% of $H_2$ at a heating speed of 15° C./h up to a temperature of 1200° C. After keeping the temperature for 5 hours in a $H_2$ atmosphere, the temperature was decreased.

The unreacted annealing separator was removed from the coil and a tension coating agent containing 50% of colloidal silica was coated on the coil with baking to produce a product.

A slit processing, shear processing and fixed lamination processing were applied to the steel sheet to produce two 3-phase transformers having a dimension of 200 mm in leg width, 800 mm in height and 350 mm in thickness. One of the transformers was produced under a as little strain as possible while the other transformer was produced by purposely giving strain, by pressing a caster carrying a spherical body with a diameter of 50 mm on the coil at a load of 5 kg, for experimentally evaluating the effect of strain.

The results of measurements of the iron loss characteristics and building factor are listed in Table 7 together with the results of studies on the magnetic characteristics of the material.

The number ratio of the grains having a diameter of 3 mm or less was determined by a macro-etching of the material and the mean diameter D of the grains having a diameter of 3 mm or more was calculated. The results are also listed in Table 7.

TABLE 6

| Kind of | Composition of component (%)* | | | | | | | | | | | |
|---|---|---|---|---|---|---|---|---|---|---|---|---|
| steel | C | Si | Mn | P | Al | S | Se | Sb | Bi | Te | B | N |
| A I | 0.075 | 3.34 | 0.07 | 0.002 | 0.023 | 0.003 | 0.02 | 0.05 | tr | 0.015 | 3 | 85 |
| A II | 0.082 | 3.35 | 0.07 | 0.005 | 0.022 | 0.005 | 0.02 | tr | 0.008 | tr | 2 | 82 |
| A III | 0.085 | 3.32 | 0.07 | 0.002 | 0.026 | 0.003 | 0.02 | tr | tr | tr | 15 | 84 |
| A IV | 0.079 | 3.36 | 0.07 | 0.003 | 0.005 | 0.004 | 0.02 | tr | tr | tr | 35 | 55 |

*B, N in ppm

TABLE 7

| | Primary | Magnetism of product | | Macro-structure of product | | Iron loss of transformer $W_{17/50}$ | | |
|---|---|---|---|---|---|---|---|---|
| Kind of steel | grain coarsening treatment | Magnetic flux density $B_8$ (T) | Iron loss $W_{17/50}$ (W/kg) | Number ratio of grains with a diameter of 3 mm or less (%) | Mean grain diameter (mm) | Building factor by non-strain processing | Building factor by strain processing | Note |
| A I | Yes | 1.932 | 0.684 | 87.2 | 21.5 | 1.15 | 1.16 | Example |
| | No | 1.933 | 0.685 | 20.3 | 42.3 | 1.28 | 1.49 | Comparative example |
| A II | Yes | 1.945 | 0.673 | 80.5 | 14.7 | 1.16 | 1.16 | Example |
| | No | 1.946 | 0.674 | 22.7 | 45.5 | 1.28 | 1.52 | Comparative example |
| A III | Yes | 1.936 | 0.683 | 85.3 | 19.8 | 1.14 | 1.14 | Example |
| | No | 1.934 | 0.684 | 24.2 | 39.6 | 1.27 | 1.46 | Comparative example |
| A IV | Yes | 1.902 | 0.783 | 89.8 | 13.2 | 1.12 | 1.13 | Example |
| | No | 1.904 | 0.784 | 32.4 | 27.5 | 1.27 | 1.45 | Comparative example |

As is evident from Table 7, the transformer produced by using the grain-oriented electromagnetic steel sheet according to this invention had a low building factor and was quite excellent in strain resistance, indicating that the steel sheet was very excellent as a iron core material of the practical transformer.

Example 4

After heating a steel slab comprising 0.08 wt % of C, 3.35 wt % of Si, 0.07 wt % of Mn, 0.02 wt % of Al, 0.05 wt % of Sb, 0.006 wt % of Te and 0.008 wt % of N with a balance of Fe and inevitable impurities at 1390° C., a hot band having a thickness of 2.2 mm was produced by a conventional method. After a hot band annealing at 1000° C. for 30 seconds followed by pickling, the sheet was cold rolled to a thickness of 1.5 mm. After applying an intermediate treatment at 1080° C. for 50 seconds, the steel sheet was finally processed to a thickness of 0.22 mm by a warm rolling at 200° C. After a degreasing treatment and a decarburization annealing at a temperature of 850° C. for 2 minutes, an annealing separator containing MgO as a main component was coated on the coil to subject to a final finish annealing.

As a final finish annealing, the coil obtained was heated in $N_2$ atmosphere at a heating speed of 30° C./h up to a temperature of 850° C. and, after keeping the temperature at 850° C. for 25 hours, the coil was then heated in a mixed gas atmosphere comprising 25% of $N_2$ and 75% of $H_2$ at a heating speed of 15° C./h up to a temperature of 1200° C. After keeping the temperature for 5 hours in a $H_2$ atmosphere, the temperature was decreased.

After removing the unreacted annealing separator, the steel sheet was divided into three pieces and one of the pieces was coated with a tension coating containing 50% of colloidal silica without any additional treatment followed by baking at 800° C. (Comparative Example).

A strain inducing treatment to press the surface areas of the steel sheet having a diameter of 2.5 mm was applied to the other piece (Example A1).

In addition to the same strain inducing treatment as described above, linearly elongating strain areas having a width of 0.5 mm were provided in the remaining one piece with a projection roll along the transverse direction (Example A2).

These example coils were also coated with a tension coating containing 50% of colloidal silica without any additional treatment followed by baking at 800° C. as in Comparative Example.

A slit processing, shear processing and fixed lamination processing were applied to the steel sheet to produce two 3-phase transformers having a dimension of 250 mm in leg width, 900 mm in height and 300 mm in thickness. One of the transformers was produced under as little strain as possible while the other transformer was produced by purposely giving strain, by pressing a caster carrying a spherical body with a diameter of 50 mm on the coil at a load of 5 kg, for experimentally evaluating the effect of strain.

The results of measurements of the iron loss characteristics and building factor are listed in Table 8 together with the results of studies on the magnetic characteristics of the material.

The number ratio of the grains having a diameter of 3 mm or less was determined by a macro-etching of the material and the mean diameter D of the grains having a diameter of 3 mm or more was calculated. The results are also listed in Table 8.

TABLE 8

| Primary grain coarsening treatment by dotted discharge | Magnetism of product: Magnetic flux density $B_8$ (T) | Magnetism of product: Iron loss $W_{17/50}$ (W/kg) | Macro-structure of product: Number ratio of fine grains with a diameter of 3 mm or less (%) | Macro-structure of product: Mean grain diameter (mm) | Iron loss of transformer $W_{17/50}$: Non-strain treatment (W/kg) | Non-strain treatment: Building factor | Strain treatment (W/kg) | Strain treatment: Building factor |
|---|---|---|---|---|---|---|---|---|
| Yes (Example A1) | 1.965 | 0.683 | 81.3 | 15.8 | 0.779 | 1.14 | 0.785 | 1.15 |
| Yes (Example A2) | 1.953 | 0.665 | 82.7 | 16.2 | 0.758 | 1.14 | 0.765 | 1.15 |
| No (Comparative example) | 1.967 | 0.685 | 28.4 | 31.3 | 0.863 | 1.26 | 1.007 | 1.47 |

As is evident from Table 8, the transformer produced by using the grain-oriented electromagnetic steel sheet according to this invention had a low building factor and was quite excellent in the strain resistant property, indicating that the steel sheet was very excellent as an iron core material of a practical transformer.

Many linear groups of grains having a size not reaching to ½ of the thickness of the steel sheet were observed at the areas where linear strains were applied with a projection roll after macro-etching of the structure in Example A2.

Example 5

Figure 10:
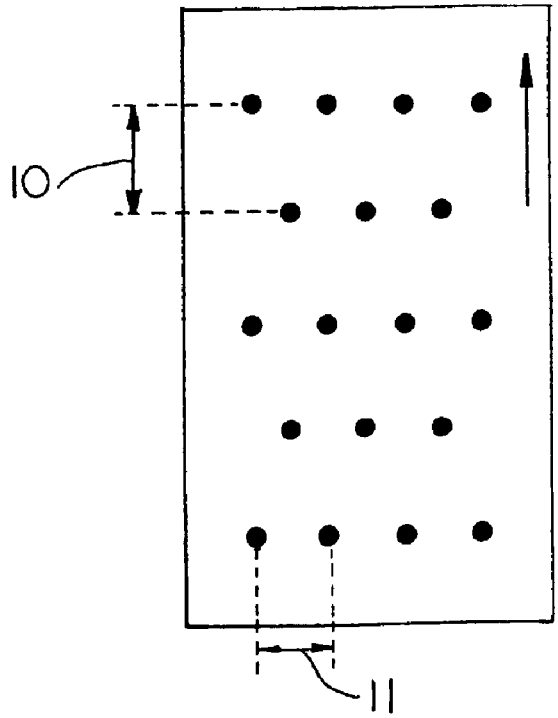
FIG. 10 is an another illustration of areas where the driving force for the abnormal grain growth is regularly provided on the surface of the steel sheet.

After heating a steel slab comprising 0.08 wt % of C, 3.40 wt % of Si, 0.04 wt % of Mn, 0.02 wt % of Al, 0.15 wt % of Cu, 0.010 wt % of Mo, 0.005 wt % of Bi and 0.008 wt % of N with a balance of Fe and inevitable impurities at 1410° C., a hot band with a thickness of 2.6 mm was prepared by a conventional method. After a hot band annealing comprising a soaking treatment at 1125° C. for 30 seconds and a quenching of 40° C./s by spraying a mist of water followed by pickling, the steel sheet was formed into a final thickness of 0.34 mm by a warm rolling at a temperature of the steel sheet of 250° C. After the degreasing treatment, the steel sheet was divided into three pieces. One of the pieces was subjected to decarburization annealing at 850° C. for 2 minutes and an annealing separator was coated on its surface (Comparative Example 1). When decarburization annealing was applied to the other piece of the steel sheet at 850° C. for 2 minutes, the steel sheet was pressed with a roll made of a ceramic having a shape as shown in FIG. 14 by rotating the roll in synchronization with the running speed of the steel sheet immediately after reaching the temperature at 850° C. A driving force enhancing treatment for the abnormal grain growth, which linearly elongated along the transverse direction with a width of 2.0 mm, was applied by a pattern as shown in FIG. 11 with a repeating pitch of 20 mm along the roll direction. After a decarburization annealing, an annealing separator containing MgO as a main component was coated on the steel sheet (Comparative Example 2). When decarburization annealing was applied to the remaining piece of steel sheet at 850° C. for 2 minutes, the steel sheet was pressed with a roll made of a ceramic having a shape as shown in FIG. 13 by rotating the roll in synchronization with the running speed of the steel sheet immediately after reaching the temperature at 850° C. A driving force enhancing treatment for the abnormal grain growth, which linearly elongated along the transverse direction with a width of 2.0 mm, was applied by a pattern as shown in FIG. 10 with a repeating pitch of 20 mm along the roll direction. Such treatment was repeatedly applied with a pitch of 25 mm along the longitudinal direction and a pitch of 20 mm along the transverse direction. 7 in FIG. 13 is a small projection and 8 in FIG. 14 is a linear projection.

Figure 15:
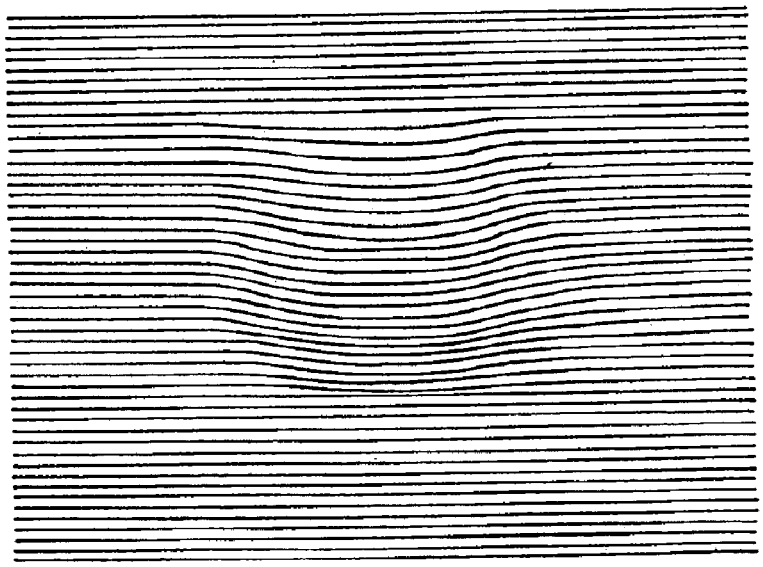
FIG. 15 is an illustrative view of a surface configuration pressed to make small projections.

An example of the surface configuration at the part pressed with small projections is shown in FIG. 15 by a three dimensional diagram of the degree of roughness.

As a final finish annealing, the coil obtained was heated in $N_2$ atmosphere at a heating speed of 30° C./h up to a temperature of 850° C. and then was heated in a mixed gas atmosphere comprising 25% of $N_2$ and 75% of $H_2$ at a heating speed of 15° C./h up to a temperature of 1200° C. After keeping the temperature for 5 hours in a $H_2$ atmosphere, the temperature was decreased.

After removing the unreacted annealing separator, the coils were coated with a tension coating containing 50% of colloidal silica to form the products.

Slit processing, shear processing and fixed lamination processing were applied to the steel sheet to produce two 3-phase transformers having a dimension of 300 mm in leg width, 1100 mm in height and 250 mm in thickness. One of the transformers was produced under as little strain as possible while the other transformer was produced by purposely giving strain, by pressing a caster carrying a spherical body with a diameter of 50 mm on the coil at a load of 5 kg, for experimentally evaluating the effect of strain.

The results of measurements of the iron loss characteristics and building factor are listed in Table 9 together with the results of studies on the magnetic characteristics of the material.

The number ratio of the grains having a diameter of 3 mm or less was determined by a macro-etching of the material and the mean diameter of the grains having a diameter of 3 mm or more was calculated. The results are also listed in Table 9.

TABLE 9

| Grain growth driving force enhancing treatment | Magnetism of product: Magnetic flux density $B_8$ (T) | Magnetism of product: Iron loss $W_{17/50}$ (W/kg) | Macro-structure of product: Number ratio of fine grains with a diameter of 3 mm or less (%) | Macro-structure of product: Mean grain diameter (mm) | Iron loss of transformer $W_{17/50}$: Non-strain treatment (W/kg) | Iron loss of transformer $W_{17/50}$: Non-strain treatment Building factor | Iron loss of transformer $W_{17/50}$: Strain treatment (W/kg) | Iron loss of transformer $W_{17/50}$: Strain treatment Building factor |
|---|---|---|---|---|---|---|---|---|
| Yes (Example) | 1.983 | 1.126 | 86.5 | 17.3 | 1.306 | 1.16 | 1.317 | 1.17 |
| No (Comparative example) | 1.984 | 1.254 | 14.7 | 38.6 | 1.605 | 1.28 | 2.069 | 1.65 |

As is evident from Table 9, Comparative Example 2 in which the driving force enhancing treatment had a linear shape resulted in greatly decreased magnetic flux density together with a high building factor and deteriorated performance of the transformer.

On the contrary, the transformer produced by using the grain-oriented electromagnetic steel sheet according to this invention had a low building factor and was excellent in strain resistance, indicating that the material was quite excellent as a core material of the practical transformer.

Example 6

After heating steel slab having a composition shown in Table 10 at 1430° C., the slab was hot rolled into a hot band with a thickness of 2.66 mm by conventional methods. After a hot band annealing at 1000° C. for 30 seconds followed by pickling, an intermediate treatment was applied at 1050° C. for 50 seconds, and a sheet with a final thickness of 0.26 mm was prepared by warm rolling at a steel sheet temperature of 230° C. A decarburization annealing was then applied at 850° C. for 2 minutes.

This steel sheet was divided into two pieces and an annealing separator containing MgO as a main component was coated on one of the pieces without any additional treatment (Comparative example).

Figure 9:
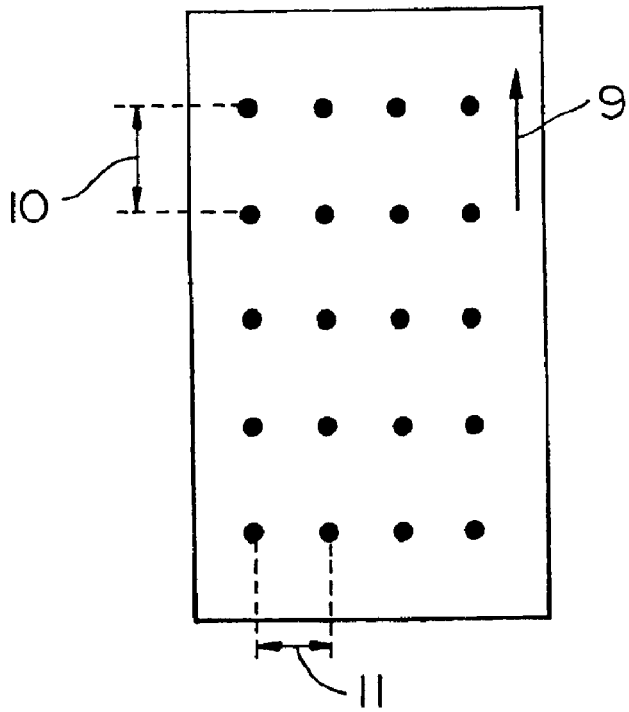
FIG. 9 is an illustration of the areas where the driving force for the abnormal grain growth is regularly provided on the surface of the steel sheet.

The steel sheet of the remaining piece was pressed with a roll made of a C quenching steel having a shape as shown in FIG. 13 by rotating the roll in synchronization with the running speed of the steel sheet. A local driving force enhancing treatment for the abnormal grain growth was applied by a pattern as shown in FIG. 9 with respect to the areas having a diameter of 1.5 mm with a maximum amount of strain of 0.15. Such areas were repeatedly provided with a pitch of 25 mm along the longitudinal direction and a pitch of 20 mm along the transverse direction. Then, an annealing separator containing MgO as a main component was also coated (Example).

As a final finish annealing, these coils obtained were heated in $N_2$ atmosphere at a heating speed of 30° C./h up to a temperature of 850° C. and, after keeping the temperature of 850° C. for 25 hours, were heated in a mixed gas atmosphere comprising 25% of $N_2$ and 75% of $H_2$ at a heating speed of 15° C./h up to a temperature of 1200° C. After keeping the temperature for 5 hours in a $H_2$ atmosphere, the temperature was decreased.

The unreacted annealing separator was removed from the each coil and a tension coating agent containing 50% of colloidal silica was coated on the coil with baking to produce a product.

Slit processing, shear processing and fixed lamination processing were applied to the steel sheet to produce two 3-phase transformers having a dimension of 200 mm in leg width, 800 mm in height and 350 mm in thickness. One of the transformers was produced under as little strain as possible while the other transformer was produced by purposely giving strain, by pressing a caster carrying a spherical body with a diameter of 50 mm on the coil at a load of 5 kg, for experimentally evaluating the effect of strain.

The results of measurements of the iron loss characteristics and building factor are listed in Table 11 together with the results of studies on the magnetic characteristics of the material.

The number ratio of the grains having a diameter of 3 mm or less was determined by a macro-etching of the material and the mean diameter of the grains having a diameter of 3 mm or more was calculated. The results are also listed in Table 11.

TABLE 10

| Kind of steel | Composition of component (%)* C | Si | Mn | P | Al | S | Se | Sb | Bi | Te | B | N |
|---|---|---|---|---|---|---|---|---|---|---|---|---|
| B I | 0.075 | 3.34 | 0.07 | 0.002 | 0.023 | 0.003 | 0.02 | 0.05 | tr | 0.015 | 3 | 85 |
| B II | 0.082 | 3.35 | 0.07 | 0.005 | 0.022 | 0.015 | tr | tr | 0.25 | tr | 2 | 82 |
| B III | 0.085 | 3.32 | 0.07 | 0.002 | 0.026 | 0.003 | 0.02 | tr | tr | tr | 15 | 84 |
| B IV | 0.079 | 3.36 | 0.07 | 0.003 | 0.005 | 0.014 | tr | tr | tr | tr | 25 | 65 |

*B, N in ppm

TABLE 11

| Kind of steel | Grain growth driving force enhancing treatment | Magnetism of product: Magnetic flux density $B_8$ (T) | Magnetism of product: Iron loss $W_{17/50}$ (W/kg) | Macro-structure of product: Number ratio of grains with a diameter of 3 mm or less (%) | Macro-structure of product: Mean grain diameter (mm) | Iron loss of transformer $W_{17/50}$: Building factor by non-strain processing | Iron loss of transformer $W_{17/50}$: Building factor by strain processing | Note |
|---|---|---|---|---|---|---|---|---|
| B I | Yes | 1.928 | 0.723 | 79.1 | 12.4 | 1.15 | 1.16 | Example |
| | No | 1.927 | 0.806 | 25.7 | 23.6 | 1.24 | 1.37 | Comparative example |
| B II | Yes | 1.947 | 0.705 | 84.6 | 14.7 | 1.16 | 1.16 | Example |
| | No | 1.946 | 0.784 | 12.1 | 47.2 | 1.26 | 1.49 | Comparative example |
| B III | Yes | 1.932 | 0.735 | 87.1 | 13.2 | 1.15 | 1.16 | Example |
| | No | 1.930 | 0.818 | 13.7 | 33.8 | 1.29 | 1.44 | Comparative example |
| B IV | Yes | 1.932 | 0.747 | 91.9 | 8.3 | 1.14 | 1.14 | Example |
| | No | 1.934 | 0.832 | 33.2 | 17.9 | 1.26 | 1.41 | Comparative example |

As is evident from Table 11, the transformer produced by using the grain-oriented electromagnetic steel sheet according to this invention had a low building factor and was excellent in strain resistant property, indicating that the material was quite excellent as a core material of the practical transformer.

Example 7

After heating a steel slab comprising 0.08 wt % of C, 3.40 wt % of Si, 0.09 wt % of Mn, 0.02 wt % of Al, 0.05 wt % of Cu, 0.005 wt % of Nb, 0.2 wt % of Ni, 0.045 wt % of Sb and 0.008 wt % of N with a balance of Fe and inevitable impurities at 1430° C., a hot band having a thickness of 2.2 mm was produced by a conventional method. After a pickling, the steel sheet was processed to an intermediate thickness of 1.5 mm by a cold rolling. An intermediate annealing comprising a soaking treatment at 1100° C. for 30 seconds and a quenching of 40° C./s by spraying a mist of water was applied to the steel sheet and, after a pickling, the steel sheet was processed into a final thickness of 0.22 mm by a warm rolling at 250° C. After a degreasing treatment, the steel sheet was divided into two pieces. After applying a decarburization annealing at a temperature of 850° C. for 2 minutes, an annealing separator containing $SiO_2$ as a main component was coated on the coil (Comparative Example).

After applying decarburization annealing to the remaining piece of the steel sheet at 850° C. for 2 minutes, the areas where a treatment for enhancing driving force for the abnormal grain growth having a strain of 0.01 to 0.08 with a diameter of 2.0 mm was applied on the surface of the steel sheet were sparsely provided with a distance of 2 to 30 mm on the surface of the steel sheet. Then an annealing separator containing $SiO_2$ as a main component was coated like in Comparative Example (Example).

As a final finish annealing, these coils obtained were heated in $N_2$ atmosphere at a heating speed of 30° C./h up to a temperature of 850° C. and, after keeping the temperature of 850° C. for 25 hours, were heated in a mixed gas atmosphere comprising 25% of $N_2$ and 75% of $H_2$ at a heating speed of 15° C./h up to a temperature of 1200° C. After keeping the temperature for 5 hours in a $H_2$ atmosphere, the temperature was decreased. Formation of any surface oxidation film was not observed in these coils thus obtained.

Then, a tensioning coating containing $B_2O_3$ was directly coated and baked to produce a product.

Slit processing, shear processing and fixed lamination processing were applied to the steel sheet to produce two 3-phase transformers having a dimension of 300 mm in leg width, 1100 mm in height and 250 mm in thickness. One of the transformers was produced under as little strain as possible while the other transformer was produced by purposely giving strain, by pressing a caster carrying a spherical body with a diameter of 50 mm on the coil at a load of 5 kg, for experimentally evaluating the effect of strain.

The results of measurements of the iron loss characteristics and building factor are listed in Table 12 together with the results of studies on the magnetic characteristics of the material.

The number ratio of the grains having a diameter of 3 mm or less was determined by a macro-etching of the material and the mean diameter of the grains having a diameter of 3 mm or more was calculated. The results are also listed in Table 12.

TABLE 12

| Primary grain coarsening treatment by dotted discharge | Magnetism of product: Magnetic flux density $B_8$ (T) | Magnetism of product: Iron loss $W_{17/50}$ (W/kg) | Macro-structure of product: Number ratio of fine grains with a diameter of 3 mm or less (%) | Macro-structure of product: Mean grain diameter (mm) | Iron loss of transformer $W_{17/50}$: Non-strain treatment (W/kg) | Iron loss of transformer $W_{17/50}$: Non-strain treatment Building factor | Iron loss of transformer $W_{17/50}$: Strain treatment (W/kg) | Iron loss of transformer $W_{17/50}$: Strain treatment Building factor |
|---|---|---|---|---|---|---|---|---|
| Yes (Example) | 1.978 | 0.623 | 85.4 | 13.2 | 0.729 | 1.17 | 0.735 | 1.18 |
| No (Comparative example) | 1.976 | 0.684 | 11.8 | 42.6 | 0.862 | 1.26 | 0.971 | 1.42 |

As is evident from Table 12, the transformer produced by using the grain-oriented electromagnetic steel sheet according to this invention had a low building factor and was quite excellent in strain resistance, indicating that the steel sheet was very excellent as a iron core material of the practical transformer.

Example 8

After heating a steel slab comprising 0.08 wt % of C, 3.40 wt % of Si, 0.04 wt % of Mn, 0.02 wt % of Al, 0.15 wt % of Cu, 0.10 wt % of Ni, 0.005 wt % of Bi, 0.04 wt % of Sb and 0.008 wt % of N with a balance of Fe and inevitable impurities at 1430° C., a hot band with a thickness of 2.6 mm was formed by a conventional method. Then a carbide content adjusting treatment comprising a soaking treatment at 750° C. for 3 seconds was applied and, after a pickling, the sheet was processed into an intermediate thickness of 1.8 mm by a cold rolling. An intermediate annealing comprising a soaking treatment at 1125° C. for 30 seconds and quenching of 40° C./s by spraying a mist of water was thereafter applied.

After a pickling, the sheet was processed into a final thickness of 0.26 mm by a warm rolling at a steel sheet temperature of 230° C. After a degreasing treatment, the steel sheet was divided into five pieces, one pieces of which was coated with an annealing separator containing MgO as a main component after applying a decarburization treatment at 850° C. for 2 minutes (Comparative Example).

When a decarburization annealing was applied to the remaining four pieces of the steel sheet at 850° C. for 2 minutes, the steel sheet was pressed with a roll made of a ceramic having a shape as shown in FIG. 12 by rotating the roll in synchronization with the running speed of the steel sheet immediately after reaching the temperature of 850° C. A local driving force enhancing treatment for the abnormal grain growth, which linearly elongated along the transverse direction with a pitch of 25 mm along the longitudinal direction and a pitch of 20 mm along the transverse direction, was applied by a pattern as shown in FIG. 10 with a diameter of 2.0 mm. With respect to the three coils, a ceramic roll having linear projections as shown in FIG. 15 was rotated in synchronization with the running coil, thereby grooves having a depth of 5 μm and a width of 100 μm elongating along the transverse direction with a pitch of 5 mm, and grooves having a depth of 30 μm and a width of 500 μm elongating along the transverse direction with a pitch of 2 mm were formed in two of the pieces and one of the pieces, respectively. After a decarburization annealing, these four coils were coated with an annealing separator containing MgO as a main component as in Comparative Example (Example).

As a final finish annealing, these coils obtained were heated in $N_2$ atmosphere at a heating speed of 30° C./h up to a temperature of 850° C. and in a mixed gas atmosphere comprising 25% of $N_2$ and 75% of $H_2$ at a heating speed of 15° C./h up to a temperature of 1200° C. After keeping the temperature for 5 hours in a $H_2$ atmosphere, the temperature was decreased.

The unreacted annealing separator was removed from each coil and a tension coating agent containing 50% of colloidal silica was coated on each coil with baking to produce a product. One of the two coils in which grooves having a depth of 5 μm are provided was irradiated with a laser beam having a diameter of 0.1 mm with repeating distances of 0.3 mm along the transverse direction (a pitch of 10 mm along the rolling direction) to provide linear local stress areas after coating tension coating with baking.

Slit processing, shear processing and fixed lamination processing were applied to the steel sheet to produce two 3-phase transformed having a dimension of 300 mm in leg width, 1100 mm in height and 250 mm in thickness. One of the transformers was produced under as little strain as possible while the other transformer was produced by purposely giving strain, by pressing a caster carrying a spherical body with a diameter of 50 mm on the coil at a load of 5 kg, for experimentally evaluating the effect of strain.

The results of measurements of the iron loss characteristics and building factor are listed in Table 13 together with the results of studies on the magnetic characteristics of the material.

The number ratio of the grains having a diameter of 3 mm or less was determined by a macro-etching of the material and the mean diameter D of the grains having a diameter of 3 mm or more was calculated. The results are also listed in Table 13.

The value of Bm=1.75T was assigned to the Bm value of the transformer for the measurement of the iron loss from mean D value of the product of 56 mm and from the relation $Bm=0.2\times\log_{10}56+1.4=1.75$.

TABLE 13

| With or without grain growth driving force enhancing treatment | Total volume ratio of grooves V log V | Area ratio of local stress treatment S log S | Magnetism of product: Magnetic flux density $B_8$ (T) | Magnetism of product: Iron loss $W_{17/50}$ (W/kg) | Macro-structure of product: Number ratio of fine grains with a diameter of 3 mm or less (%) | Macro-structure of product: Mean diameter of grains with a diameter of more than 3 mm D (mm) | Building factor of transformer iron loss: Building factor by non-strain processing | Building factor of transformer iron loss: Building factor by strain processing | Note |
|---|---|---|---|---|---|---|---|---|---|
| No | No | No | 1.986 | 1.012 | 18.3 | 56.3 | 1.28 | 1.75 | Comparative example |
| Yes | No | No | 1.985 | 0.926 | 85.7 | 55.4 | 1.19 | 1.21 | Comparative example |
| | $7.2 \times 10^{-4}$ – 3.14 | No | 1.923 | 0.783 | 88.2 | 55.8 | 1.15 | 1.17 | Example |
| | $7.2 \times 10^{-4}$ – 3.14 | $2.6 \times 10^{-3}$ – 2.59 | 1.924 | 0.762 | 84.3 | 56.1 | 1.14 | 1.15 | Example |
| | $5.1 \times 10^{-3}$ – 2.29 | No | 1.912 | 0.827 | 87.6 | 56.4 | 1.17 | 1.26 | Example |

As is evident from Table 13, the iron loss of the product in the Example in which a driving force enhancing treatment for the abnormal grain growth was applied was largely decreased compared with that in Comparative example with a lower building factor, indicating that the performance of the transformer was excellent.

Especially, when the volume of the grooves was adjusted to a proper range relative to the mean grain diameter D, the building factor of the transformer was the smallest besides having a very good strain resistant property, indicating that the steel sheet was quite excellent as a core material of the transformer.

Example 9

After heating a steel slab comprising 0.05 wt % of C, 3.15 wt % of Si, 0.35 wt % of Mn, 0.017 wt % of Al, 0.005 wt % of Sb, 0.0005 wt % of B and 0.008 wt % of N with a balance of Fe and inevitable impurities at 1180° C., a hot band with a thickness of 2.4 mm was formed by a conventional method. Then, after applying a hot band annealing at 800° C. for 30 seconds followed by a pickling, the sheet was processed into a final thickness of 0.34 mm by a warm rolling at a steel sheet temperature of 195° C. After a degreasing treatment, the sheet was subjected to a decarburization annealing at a temperature of 820° C. for 2 minutes.

This steel sheet was divided into four pieces, one of which was formed into a product by coating with baking after a secondary recrystallization annealing at 1000° C. for 30 seconds (Comparative Example).

A spot laser was irradiated to the remaining three coils in a furnace at 1000° C. for 3 minutes at the temperature increasing step before the start of the secondary recrystallization and halfway along the secondary recrystallization annealing at 1000° C., and a driving force enhancing treatment for the abnormal grain growth was applied to the steel sheet using a pattern as shown in FIG. 10 in the local strain areas with a diameter of 2.5 mm. Such areas were repeatedly provided with a pitch of 30 mm along the longitudinal direction and a pitch of 25 mm along the transverse direction. Then, a product was prepared by coating with baking. Two coils of the three coils were chemically polished prior to coating with the coating liquid, wherein the surface roughnesses of the coils were 0.07 $\mu$m for one coil and 0.26 $\mu$m for the other coil.

Slit processing, shear processing and fixed lamination processing were applied to the steel sheet to produce two 3-phase transformers having a dimension of 200 mm in leg width, 800 mm in height and 350 mm in thickness. One of the transformers was produced under as little strain as possible while the other transformer was produced by purposely giving strain, by pressing a caster carrying a spherical body with a diameter of 50 mm on the coil at a load of 5 kg, for experimentally evaluating the effect of strain.

The results of measurements of the iron loss characteristics and building factor are listed in Table 14 together with the results of studies on the magnetic characteristics of the material.

The number ratio of the grains having a diameter of 3 mm or less was determined by macro-etching of the material and the mean diameter D of the grains having a diameter of 3 mm or more was calculated. The results are also listed in Table 14.

The value of Bm=1.60T was assigned to the Bm value of the transformer for the measurement of the iron loss from mean D value of the product of 10 mm and from the relation of $Bm=0.2\times\log_{10}10+1.4=1.60$.

As is evident from Table 14, the performance of the transformer assembled by using the grain-oriented electromagnetic steel sheet according to this invention had good performance as a practical device with a low building factor and good strain resistant property, indicating that the coil was quite excellent as a core material for practical transformers.

TABLE 14

| With or without grain growth driving force enhancing treatment | Surface roughness of steel sheet Ra (μm) | Magnetism of product: Magnetic flux density $B_8$ (T) | Magnetism of product: Iron loss $W_{17/50}$ (W/kg) | Macro-structure of product: Number ratio of fine grains with a diameter of 3 mm or less (%) | Macro-structure of product: Mean diameter of grains with a diameter of more than 3 mm D (mm) | Building factor of transformer iron loss: Building factor by non-strain processing | Building factor of transformer iron loss: Building factor by strain processing | Note |
|---|---|---|---|---|---|---|---|---|
| No | 0.78 | 1.886 | 1.17 | 18.3 | 9.5 | 1.24 | 1.65 | Comparative example |
| Yes | 0.74 | 1.882 | 1.12 | 79.9 | 10.2 | 1.17 | 1.20 | Example |
| | 0.07 | 1.904 | 1.06 | 80.5 | 10.1 | 1.13 | 1.14 | Example |
| | 0.26 | 1.897 | 1.11 | 81.3 | 10.3 | 1.16 | 1.19 | Example |

Example 10

After heating a steel slab comprising 0.08 wt % of C, 3.40 wt % of Si, 0.09 wt % of Mn, 0.02 wt % of Al, 0.010 wt % of Cu, 0.010 wt % of Mo, 0.2 wt % of Ni, 0.045 wt % of Sb and 0.008 wt % of N with a balance of Fe and inevitable impurities at 1440° C., a hot band with a thickness of 2.2 mm was formed by a conventional method. After processing the steel sheet to an intermediate thickness of 1.8 mm by a cold rolling after a pickling, an intermediate annealing comprising a soaking treatment at 1100° C. for 30 seconds and quenching of 40° C./s by spraying a mist of water was applied followed by a pickling. A steel sheet having a final thickness of 0.22 mm was prepared by a warm rolling with a temperature of the steel sheet of 200° C.

After a degreasing treatment, the steel sheet was divided into six pieces, one of which was coated with an annealing separator containing MgO as a main component after a decarburization annealing at 850° C. for 2 minutes (Comparative Example).

After applying a decarburization annealing to the remaining five coils at 850° C. for 2 minutes, the areas where a treatment for enhancing driving force for the abnormal grain growth having a strain of 0.01 to 0.08 with a diameter of 2.0 mm was applied on the surface of the steel sheet were sparsely and locally provided with a distance of 2 to 30 mm on the surface of the steel sheet by irradiating a pulse laser. Then an annealing separator containing $SiO_2$ as a main component was coated on the three coils of the five coils as in the Comparative Example, while the remaining two coils were coated with an annealing separator containing $SiO_2$ as a main component to suppress the formation of a film (Examples).

As a final finish annealing, the coil obtained was heated in $N_2$ atmosphere at a heating speed of 30° C./h up to a temperature of 850° C. and in a mixed gas atmosphere comprising 25% of $N_2$ and 75% of $H_2$ at a heating speed of 15° C./h up to a temperature of 1200° C. After keeping the temperature for 5 hours in a $H_2$ atmosphere, the temperature was decreased.

These coils were coated with a tension coating containing $B_2O_3$ with baking to produce the products.

Since formation of surface oxide film was not observed in the coils coated with an annealing separator containing $SiO_2$ as a main component among the coils in the Examples, the tension coating described above was coated on them with baking after applying a crystal orientation emphasizing treatment in an aqueous solution of sodium chloride. The mean grain boundary step of one of the two coils was 2.5 μm while that of the other coil was 0.9 μm.

The coils on which an annealing separator containing MgO as a main component were coated among the Examples was coated with a tension coating described above with baking on the forsterite film formed on the surface of the steel sheet. After coating and baking such tension coating, two coils of the three coils were linearly irradiated with a plasma jet along the transverse direction. One of the coil was irradiated ($S=3.3\times10^{-1}$) with a pitch of 15 mm along the roll direction of the steel sheet to form local stress areas having a width of 0.05 mm while the other coil was irradiated ($S=1.6\times10^{-1}$) with a pitch of 5 mm along the roll direction of the steel sheet to form local stress areas having a width of 0.8 mm.

Slit processing, shear processing and fixed lamination processing were applied to the steel sheet to produce two 3-phase transformers having a dimension of 300 mm in leg width, 1100 mm in height and 250 mm in thickness. One of the transformers was produced under as little strain as possible while the other transformer was produced by purposely giving strain, by pressing a caster carrying a spherical body with a diameter of 50 mm on the coil at a load of 5 kg, for experimentally evaluating the effect of strain.

The results of measurements of the iron loss characteristics and building factor are listed in Table 15 together with the results of studies on the magnetic characteristics of the material.

The number ratio of the grains having a diameter of 3 mm or less was determined by a macro-etching of the material and the mean diameter D of the grains having a diameter of 3 mm or more was calculated. The results are also listed in Table 15.

The value of Bm=1.80T was assigned to the Bm value of the transformer for the measurement of the iron loss from mean D value of the product of 100.5 mm and from the relation of $Bm=0.2\times\log_{10}100.5+1.4=1.80$.

TABLE 15

| With or without grain growth driving force enhancing treatment | Grain boundary step after crystal orientation emphasizing treatment BS (μm) | Local stress area ratio by plasma jet irradiation S | Magnetism of product: Magnetic flux density $B_8$ (T) | Magnetism of product: Iron loss $W_{17/50}$ (W/kg) | Macro-structure of product: Number ratio of fine grains with a diameter of 3 mm or less (%) | Macro-structure of product: Mean diameter of grains with a diameter of more than 3 mm D (mm) | Building factor of transformer iron loss: Building factor by non-strain processing | Building factor of transformer iron loss: Building factor by strain processing | Note |
|---|---|---|---|---|---|---|---|---|---|
| No | No | No | 1.975 | 1.142 | 27.3 | 102.4 | 1.37 | 1.69 | Comparative example |
| Yes | No | No | 1.973 | 0.926 | 87.1 | 98.5 | 1.21 | 1.24 | Comparative example |
| | 2.5 | No | 1.969 | 0.913 | 88.5 | 101.2 | 1.19 | 1.21 | Example |
| | 0.9 | No | 1.976 | 0.901 | 87.3 | 104.1 | 1.17 | 1.19 | Example |
| | No | $3.3 \times 10^{-3}$ | 1.975 | 0.911 | 86.3 | 98.3 | 1.18 | 1.20 | Example |
| | No | $1.6 \times 10^{-1}$ | 1.974 | 0.903 | 85.8 | 98.6 | 1.17 | 1.19 | Example |

As is evident from Table 15, the performance of the transformer assembled by using the grain-oriented electromagnetic steel sheet according to this invention had a good performance as a practical device with a low building factor and good strain resistant property, indicating that the coil is quite excellent as a core material for the practical transformers.

Example 11

After heating a steel slab comprising 0.08 wt % of C, 3.45 wt % of Si, 0.07 wt % of Mn, 0.02 wt % of Al, 0.015 wt % of Ge, 0.010 wt % of Mo, 0.1 wt % of Ni, 0.050 wt % of Sb, 0.05 wt % of Cr and 0.008 wt % of N with a balance of Fe and inevitable impurities at 1400° C., a hot band with a thickness of 2.4 mm was formed by a conventional method. After processing the steel sheet to an intermediate thickness of 1.5 mm followed by a pickling, an intermediate annealing comprising a soaking treatment at 1100° C. for 30 seconds and quenching of 40° C./s by spraying a mist of water was applied followed by a pickling. A steel sheet having a final thickness of 0.17 mm was prepared by a warm rolling with a temperature of the steel sheet of 200° C.

After a degreasing treatment, the steel sheet was divided into four pieces, one of which was coated with an annealing separator containing MgO as a main component after a decarburization annealing at 850° C. for 2 minutes (Comparative Example 1).

With respect to the other coil, a ceramic roll having linear projections as shown in FIG. 14 was rotated in synchronization with the running coil immediately after the temperature increase for the decarburization annealing. Thereby grooves were formed having a depth of 30 μm and a width of 35 μm along the rolling direction with a pitch of 4 mm on the surface of the steel sheet (Comparative Example 2).

With respect to another coil, a ceramic roll having linear projections as shown in FIG. 14 was rotated in synchronization with the running coil immediately after the temperature increase for decarburization annealing; thereby grooves having a depth of 10 μm and a width of 80 μm along the rolling direction with a repeating distance of 5 mm on the surface of the steel sheet were formed (Comparative Example 3).

With respect to the one remaining coil, a ceramic roll having linear projections as shown in FIG. 14 was rotated in synchronization with the running coil immediately after temperature increase for decarburization annealing. Thereby grooves having a depth of 10 μm and a width of 80 μm along the rolling direction with a repeating distance of 5 mm were provided on the surface of the steel sheet, and then a roll having small projections as shown in FIG. 13 was rotated in synchronization with the running coil after decarburization annealing, thereby the areas where a treatment for enhancing driving force for the abnormal grain growth having a strain of 0.03 to 0.15 with a diameter of 1.5 mm was applied on the surface of the steel sheet were sparsely and locally provided with a repeating distance of 500 mm along the roll direction on the surface of the steel sheet as shown in FIG. 9.

These three coils were coated with an annealing separator containing MgO as a main component.

As a final finish annealing, the coil obtained was heated in $N_2$ atmosphere at a heating speed of 30° C./h up to a temperature of 850° C. and after keeping a temperature of 850° C. for 20 hours, the coil was heated in a mixed gas atmosphere comprising 25% of $N_2$ and 75% of $H_2$ at a heating speed of 15° C./h up to a temperature of 1200° C. After keeping the temperature for 5 hours in a $H_2$ atmosphere, the temperature was decreased.

A tension coating agent containing colloidal silica was coated on these coils and the coils were baked at 800° C. for serving also as a flattening annealing.

Slit processing, shear processing and fixed lamination processing were applied to the steel sheet to produce two 3-phase transformers having a dimension of 300 mm in leg width, 1100 mm in height and 250 mm in thickness. One of the transformers was produced under as little strain as possible while the other transformer was produced by purposely giving strain, by pressing a caster carrying a spherical body with a diameter of 50 mm on the coil at a load of 5 kg, for experimentally evaluating the effect of strain.

The results of measurements of the iron loss characteristics and building factor are listed in Table 16 together with the results of studies on the magnetic characteristics of the material.

The number ratio of the grains having a diameter of 3 mm or less was determined by a macro-etching of the material and the mean diameter D of the grains having a diameter of 3 mm or more was calculated. The results are also listed in Table 16.

TABLE 16

| With or without grain growth driving force enhancing treatment | Total volume ratio of grooves V log V | Magnetism of product: Magnetic flux density $B_8$ (T) | Magnetism of product: Iron loss $W_{17/50}$ (W/kg) | Macro-structure of product: Number ratio of fine grains with a diameter of 3 mm or less (%) | Macro-structure of product: Mean diameter of grains with a diameter of more than 3 mm D (mm) | Building factor of transformer iron loss: Building factor by non-strain processing | Building factor of transformer iron loss: Building factor by strain processing | Note |
|---|---|---|---|---|---|---|---|---|
| No | No | 1.957 | 0.956 | 14.9 | 56.4 | 1.25 | 1.36 | Comparative example 1 |
| | $2.6 \times 10^{-3}$ – 2.59 | 1.895 | 0.914 | 12.5 | 8.4 | 1.33 | 1.59 | Comparative example 2 |
| | $1.2 \times 10^{-4}$ – 3.92 | 1.949 | 0.864 | 17.2 | 58.7 | 1.28 | 1.42 | Comparative example 3 |
| Yes | $1.2 \times 10^{-4}$ – 3.92 | 1.948 | 0.634 | 81.4 | 59.1 | 1.17 | 1.19 | Example |

While the Comparative Example 1 and Comparative Example 3 had ordinary crystal structures in the results of macro-etching of the products, long and slender grains were formed along the grooves just under the areas where grooves with a depth of 25 $\mu$m were provided immediately after temperature increase for decarburization annealing in Comparative Example 2. The ordinary secondary recrystallization grains were interrupted by these grains.

In contrast, fine grains were formed at the areas where a growth enhancing treatment for the abnormal grain growth was applied in the Examples. Therefore, materials excellent not only in performance of practical transformers but also in strain resistance were obtained.

According to this invention, the excellent characteristics of the steel sheet material are directly related to the transformer; thereby a transformer having a good performance as a practical device is available even after the material is assembled.

What is claimed is:

1. A method for producing a grain-oriented electromagnetic steel sheet having a low iron loss and excellent strain resistance and performance:

forming a hot band for grain-oriented electromagnetic steel containing about 0.010 to 0.120 wt % of C, 1.5 to 7.0 wt % of Si and about 0.03 to 2.5 wt % of Mn, which contains one or more elements selected from the group consisting of Al, B, Sb, Bi and Te in a proportion of about 0.005 to 0.060 wt % in the case of Al, Sb or Te, about 0.0003 to 0.0025 wt % in the case of B and about 0.0003 to 0.0090 wt % in the case of Bi, as inhibitor components, into a final thickness of said sheet by one time cold rolling or by twice or more cold rolling with intermediate annealing with a reduction of 80 to 95% during the final cold rolling after applying, if necessary, annealing said hot band;

annealing the steel sheet under conditions conducive to primary recrystallization;

applying a multiplicity of dispersed dotted strains, each dotted strain having a diameter of about 0.1 to 4.5 mm, to a surface of said steel sheet after secondary recrystallization and finish annealing;

and generating dispersed fine grains having a diameter of about 3mm or less by annealing at a temperature of about 700° C. or more after applying the dotted strains.

2. The method as defined in claim 1, wherein the strains are disposed in a pattern with a pitch of 2 mm–60 mm.

3. The method as defined in claim 1, wherein the strains are randomly dispersed.

4. The method as defined in claim 1, wherein the dotted strain is applied by either pressing onto the surface of said sheet a rigid body that is harder than said steel sheet, and having small projections on its surface, or locally applying charge or discharge electricity to the surface of said steel sheet with high voltage; or momentarily irradiating said sheet surface with a high temperature spot laser; or locally irradiating said sheet surface with a pulse laser.

5. The method as defined in claim 1, wherein the fine grains have a random orientation.

6. The method in claim 1, wherein dispersed fine grains having an orientation deviated from Goss orientation by 15° or more are caused by the annealing after applying the dotted strains.

7. A method for producing a grain-oriented electromagnetic steel sheet having a low iron loss and excellent strain resistance and performance:

forming a hot band for grain-oriented electromagnetic steel containing about 0.010 to 0.120 wt % of C, 1.5 to 7.0 wt % of Si and about 0.03 to 2.5 wt % of Mn, which contains one or more elements selected from the group consisting of Al, B, Sb, Bi and Te in a proportion of about 0.005 to 0.060 wt % in the case of Al, Sb or Te, about 0.0003 to 0.0025 wt % in the case of B and about 0.0003 to 0.0090 wt % in the case of Bi, as inhibitor components, into a final thickness of said sheet by one time cold rolling or by twice or more cold rolling with intermediate annealing with a reduction of 80 to 95% during the final cold rolling after applying, if necessary, annealing said hot band;

annealing the steel sheet under conditions conducive to primary recrystallization;

directly applying a multiplicity of dispersed dotted strains, each dotted strain having a diameter of about 0.1 to 4.5 mm, to a surface of said steel sheet after secondary recrystallization and finish annealing; and generating dispersed fine grains having a diameter of about 3 mm or less by annealing at a temperature of about 700° C. or more after applying the dotted strains.

8. The method as defined in claim 7, wherein the strains are disposed in a pattern with a pitch of 2 mm–60 mm.

9. The method as defined in claim 7, wherein the strains are randomly dispersed.

10. The method as defined in claim 7, wherein the dotted strain is applied by either pressing onto the surface of said sheet a rigid body that is harder than said steel sheet, and having small projections on its surface, or locally applying charge or discharge electricity to the surface of said steel sheet with high voltage; or momentarily irradiating said sheet surface with a high temperature spot laser; or locally irradiating said sheet surface with a pulse laser.

11. The method as defined in claim 7, wherein the fine grains have a random orientation.

12. The method in claim 7, wherein dispersed fine grains having an orientation deviated from Goss orientation by 15° or more are caused by the annealing after applying the dotted strains.

13. A method for producing a grain-oriented electromagnetic steel sheet having a low iron loss and excellent strain resistance and performance comprising:

forming a hot band for grain-oriented electromagnetic steel containing about 0.010 to 0.120 wt % of C, 1.5 to 7.0 wt % of Si and about 0.03 to 2.5 wt % of Mn, which contains one or more elements selected from the group consisting of Al, B, Sb, Bi and Te in a proportion of about 0.005 to 0.060 wt % in the case of Al, Sb or Te, about 0.0003 to 0.0025 wt % in the case of B and about 0.0003 to 0.0090 wt % in the case of Bi, as inhibitor components, into a final thickness of said sheet by one time cold rolling or by twice or more cold rolling with intermediate annealing with a reduction of 80 to 95% during the final cold rolling after applying, if necessary, annealing said hot band;

annealing the steel sheet under conditions conducive to primary recrystallization;

applying a multiplicity of dispersed dotted strains, each dotted strain having a diameter of about 0.1 to 4.5 mm, to a surface of said steel sheet after secondary recrystallization and finish annealing, but prior to applying any coating to the surface of the steel sheet; and generating dispersed fine grains having a diameter of about 3 mm or less by annealing at a temperature of about 700° C. or more after applying dotted strains.

14. The method as defined in claim 13, wherein the strains are disposed in a pattern with a pitch of 2 mm–60 mm.

15. The method as defined in claim 13, wherein the strains are randomly dispersed.

16. The method as defined in claim 13, wherein the dotted strain is applied by either pressing onto the surface of said sheet a rigid body that is harder than said steel sheet, and having small projections on its surface, or locally applying charge or discharge electricity to the surface of said steel sheet with high voltage; or momentarily irradiating said sheet surface vith a high temperature spot laser; or locally irradiating said sheet surface with a pulse laser.

17. The method as defined in claim 13, wherein the fine grains have a random orientation.

18. The method in claim 13, wherein dispersed fine grains having an orientation deviated from Goss orientation by 15° or more are caused by the annealing after applying the dotted strains.

19. The method as defined in claim 1, wherein the strains are sparsely disposed in a pattern, wherein sparsely is defined as a pitch of 2 mm to 30 mm.

20. The method as defined in claim 7, wherein the strains are sparsely disposed in a pattern, wherein sparsely is defined as a pitch of 2 mm to 30 mm.

21. The method as defined in claim 13, wherein the strains are sparsely disposed in a pattern, wherein sparsely is defined as a pitch of 2 mm to 30 mm.

* * * * *

UNITED STATES PATENT AND TRADEMARK OFFICE

CERTIFICATE OF CORRECTION

PATENT NO. : 6,929,704 B2
DATED : August 16, 2005
INVENTOR(S) : Komatsubara et al.

It is certified that error appears in the above-identified patent and that said Letters Patent is hereby corrected as shown below:

Column 42,
Line 32, change "($S=3.3x10^{-1}$)" to -- ($S=3.3x10^{-3}$) --.

Signed and Sealed this

Twenty-first Day of February, 2006

JON W. DUDAS
*Director of the United States Patent and Trademark Office*